US006134395A

United States Patent [19]

Sasaki et al.

[11] Patent Number: 6,134,395

[45] **Date of Patent: *Oct. 17, 2000**

[54] IMAGE FORMING APPARATUS CAPABLE OF PREVENTING ADHESION OF A DEVELOPER TO AN UNCHARGED REGION OF A LATENT IMAGE CARRIER

[75] Inventors: Sachio Sasaki; Hiroshi Nou; Masahiro Wanou; Masatoshi Kimura, all of Kawasaki, Japan

[73] Assignee: Fujitsu Limited, Kawasaki, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/121,512

[22] Filed: Sep. 16, 1993

[30] Foreign Application Priority Data

Mar. 19, 1993 [JP] Japan ..... 5-085684

[51] Int. Cl.[7] ..... G03G 15/00

[52] U.S. Cl. ..... 399/46; 399/50; 399/53; 399/55; 399/149

[58] Field of Search ..... 355/204, 208, 355/245, 246; 399/149, 150, 46, 50, 53, 55

[56] References Cited

U.S. PATENT DOCUMENTS

| | | | |
|---|---|---|---|
| 4,373,798 | 2/1983 | Tsukada et al. | 355/253 |
| 4,996,567 | 2/1991 | Watari et al. | 355/208 |
| 5,148,219 | 9/1992 | Kohyama | 355/219 |
| 5,155,533 | 10/1992 | Kurokawa et al. | 355/246 |
| 5,164,773 | 11/1992 | Nishio et al. | 355/245 |
| 5,283,615 | 2/1994 | Yokoyama et al. | 355/245 |
| 5,294,964 | 3/1994 | Oshiumi | 355/270 |

FOREIGN PATENT DOCUMENTS

| | | |
|---|---|---|
| 60-063569 | 4/1985 | Japan . |
| 62-040480 | 2/1987 | Japan . |
| 2-010380 | 1/1990 | Japan . |
| 2-148076 | 6/1990 | Japan . |
| 3-24569 | 2/1991 | Japan . |
| 3-278073 | 12/1991 | Japan . |
| 4-016956 | 1/1992 | Japan . |
| 4-166957 | 6/1992 | Japan . |
| 4-277773 | 10/1992 | Japan . |

*Primary Examiner*—William J. Royer
*Attorney, Agent, or Firm*—Armstrong, Westerman, Hattori, McLeland & Naughton

[57] ABSTRACT

An image forming apparatus capable of preventing unnecessary adhesion of a developer to an uncharged region of a latent image carrier. The image forming apparatus includes an endless latent image carrier, a charging unit for charging the latent image carrier, a latent image forming unit for forming a latent image on the latent image carrier charged, a developing unit for developing the latent image formed on the latent image carrier with a developer by supplying the developer to the latent image carrier under application of a developing bias voltage, and a transfer unit for transferring the image developed on the latent image carrier to a sheet. The image forming apparatus further includes a driving member for rotating the latent image carrier and for driving the developing unit to supply the developer to the latent image carrier, and a controller for effecting sequence control such that the application of the developing bias voltage to the developing unit is started a predetermined time after the rotation of the latent image carrier and the drive of the developing unit and also the charging operation of the charging unit have been started. Alternatively, a driving member for driving the developing unit is provided separately, and the controller effects sequence control such that the drive of the developing unit and the application of the developing bias voltage to the developing unit are started a predetermined time after the rotation of the latent image carrier and the charging operation of the charging unit have been started.

15 Claims, 21 Drawing Sheets

IMAGE FORMING APPARATUS CAPABLE OF PREVENTING ADHESION OF A DEVELOPER TO AN UNCHARGED REGION OF A LATENT IMAGE CARRIER

BACKGROUND OF THE INVENTION

1. Field of the Invention

The present invention relates to an image forming apparatus having a developing unit for developing a latent image formed on a latent image carrier. More particularly, the present invention relates to an image forming apparatus capable of effecting control to prevent adhesion of a developer to an uncharged region of a latent image carrier.

2. Description of the Related Art

Image forming apparatuses, such as a copying machine, a printer, and a facsimile, use a latent image forming type recording apparatus, e.g., an electrophotographic apparatus, to meet the demand for plain paper recording. In such an image forming apparatus, an electrostatic latent image is formed on a photosensitive drum and then developed to a visible image with a toner. After the toner image has been transferred to a sheet of paper, the sheet is separated from the photosensitive drum, and then the toner image on the sheet is fixed thereto.

In the above-described image forming apparatus, the presence of unnecessary toner on the photosensitive drum, which is not transferred to the sheet, leads to unnecessary consumption of the developer, thus giving rise to problems in terms of both environment and cost. In cleanerless image forming apparatuses, in which no cleaner for the photosensitive drum is provided, but the residual toner on the photosensitive drum is collected at the developing unit, the amount of unnecessary toner to be collected increases. Consequently, uncollectable toner locally remains as a residual image on the photosensitive drum, which produces an adverse effect on the following image formation. Thus, there has been a demand for a technique which eliminates the presence of unnecessary toner on the photosensitive drum.

FIGS. 1A and 1B illustrate a conventional image forming apparatus. As shown in FIG. 1A, an electrophotographic printer has a photosensitive drum 1 of, for example, an organic photosensitive material, a Se photosensitive material, an a-Si photosensitive material, etc. Around the photosensitive drum 1 are disposed a corona charger 2 for uniformly charging the surface of the photosensitive drum 1, a laser optical system 3 for effecting image exposure, a developing unit 4, e.g., two-component developing unit, a magnetic, single-component developing unit, non-magnetic, single-component developing unit, etc., a roller transfer unit 5 for electrostatically transferring the toner image formed on the photosensitive drum 1 to a sheet of paper 8, and a cleaner 6, e.g., a fur brush cleaner, a blade cleaner, etc. In addition, a fixing unit 9 is disposed on a transport path for feeding the sheet 8. The fixing unit 9 fixes the toner image to the sheet 8 by heat or pressure.

The printing operation of the image forming apparatus is as follows: First, the surface of the photosensitive drum 1 is uniformly charged by the corona charger 2. Next, the charged surface of the photosensitive drum 1 is exposed to a light image corresponding to an image to be printed by the laser optical system 3, thereby forming an electrostatic latent image in accordance with the image. Next, as the photosensitive drum 1 passes the developing unit 4, a precharged toner adheres to the electrostatic latent image on the photosensitive drum 1. Thus, a toner image is formed.

Meantime, the sheet 8 to be printed with the image is fed to a position where it comes in contact with the toner image formed on the photosensitive drum 1. The roller transfer unit 5 presses against the photosensitive drum 1 under a predetermined pressure with the sheet 8 held therebetween and charges the sheet 8 in opposite polarity relation to the toner charge. Thus, the toner image on the photosensitive drum 1 is electrostatically transferred to the sheet 8. While the sheet 8 carrying the toner image is passing through the fixing unit 9, the toner image is fixed to the sheet 8 by heat and pressure.

In the meantime, the toner remaining on the photosensitive drum I after the toner image has been transferred to the sheet 8 is removed and collected by the cleaner 6. Thus, the photosensitive drum 1 is returned to the initial state to repeat the printing operation.

The toner removed and collected from the photosensitive drum 1 by the cleaner 6 is transported by a toner transport mechanism (not shown) to a waste toner tank (not shown) where it is temporarily stored. When a predetermined amount of waste toner has been collected, it is taken out of the apparatus and thrown away by the user.

In the above-described image forming apparatus, the electric charge accumulated on the photosensitive drum 1 disappears during the time when the apparatus is at rest or stands by for a print command. Particularly, in a region of the photosensitive drum 1 that is defined between the charger 2 and the developing unit 4 as shown in FIG. 1B, the charge disappears while the apparatus is at rest or standing by, although the surface of the photosensitive drum 1 in this region is charged by the charger 2 before the apparatus is brought to a rest or stand-by state. Thus, the region becomes an uncharged region (a region where the electric potential is zero).

Meantime, in the developing unit 4 that adopts the bias developing method, a developing bias potential (e.g., −350 V) which is approximately middle between the charging potential (e.g., −700 V) and the potential (e.g., about 0 V) at the exposed portion is applied to a developing roller, as shown in FIG. 2A. Thus, the toner, which has been negatively charged, electrostatically adheres to the exposed portion due to the difference between the potential of the exposed portion and the potential of the developing roller, but the toner does not adhere to the non-exposed portion because it is at the charging potential.

According to the prior art, the photosensitive drum 1, the charger 2 and the developing unit 4 are simultaneously activated in the initial sequence carried out at the time of starting the apparatus. Thus, since the developing roller of the developing unit 4 rotates with the developing bias potential applied thereto, when the above-described uncharged region of the photosensitive drum 1, which extends from the charger 2 to the developing unit 4, passes the developing unit 4, the toner adheres to the uncharged region, as shown in FIG. 2B, according to the principle as shown in FIG. 2A. Thus, the toner adheres to the whole surface of the photosensitive drum 1.

Accordingly, the toner is unnecessarily consumed, resulting in a high running cost. In addition, since the collected toner is thrown away, the prior art is unfavorable from the environmental point of view. Furthermore, the residual toner on the photosensitive drum 1 is likely to adhere to the transfer roller 5, causing the paper to be stained during the subsequent printing process.

To solve the above-described problem, a method has been proposed wherein a contact type developing unit, in which a developing roller is brought into contact with the photosensitive drum 1 to effect development, is provided with a mechanism for bringing the developing unit into and out of contact with the photosensitive drum 1, and wherein when printing is not carried out, the developing unit 4 is held separate from the photosensitive drum 1, and only when printing is to be carried out, the developing unit 4 is brought into contact with the photosensitive drum 1. The proposed method makes it possible to prevent the toner from adhering to the above-described uncharged region and hence avoid unnecessary consumption of the toner.

There has been proposed another conventional technique wherein the transfer roller 5 is provided with a mechanism for bringing it into and out of contact with the photosensitive drum 1, and wherein the transfer roller 5 has previously been separated from the photosensitive drum 1, and after the above-described uncharged region has passed the transfer roller position, the transfer roller 5 is brought into contact with the photosensitive drum 1 (for example, see Japanese Patent Application Laid-Open (KOKAI) No.02-148076). According to this method, although some toner is unnecessarily consumed, no toner will adhere to the transfer roller 5. Therefore, it is possible to prevent the transfer roller 5 from being stained with toner.

However, the conventional method in which the developing unit is selectively brought into and out of contact with the photosensitive drum suffers from the problem that since the developing unit is generally heavy in comparison to other process parts, the mechanism for bringing it into and out of contact with the photosensitive drum unavoidably becomes complicated and costly. Moreover, it becomes necessary to provide a space for the stroke of the developing unit and the mechanism therefor, resulting in an increase in the overall size of the apparatus.

The other conventional method, in which the transfer roller is withdrawn from the position where it is in contact with the photosensitive drum, can prevent the transfer roller from being stained with toner but cannot avoid adhesion of unnecessary toner to the photosensitive drum. Thus, unnecessary consumption of toner cannot be prevented.

In particular, if this method is used for a cleanerless process in which no cleaner is provided, but the residual toner is collected at the developing unit, a large amount of toner cannot satisfactorily be collected at the developing unit, so that uncollected toner is left on the photosensitive drum, causing scumming.

SUMMARY OF THE INVENTION

It is an object of the present invention to provide an image forming apparatus capable of preventing adhesion of unnecessary toner in the early stage of printing process.

It is another object of the present invention to provide an image forming apparatus capable of preventing adhesion of unnecessary toner in the early stage of printing process without moving the developing unit.

It is still another object of the present invention to provide an image forming apparatus capable of smoothly executing a cleanerless process by effectively preventing adhesion of unnecessary toner in the early stage of printing process.

To attain the above-described objects, the present invention provides an image forming apparatus including an endless latent image carrier, and a charging unit for charging the latent image carrier. A latent image forming unit forms a latent image on the latent image carrier charged. A developing unit develops the latent image formed on the latent image carrier with a developer by supplying the developer to the latent image carrier under application of a developing bias voltage. A transfer unit transfers the image developed on the latent image carrier to a sheet. A driving unit rotates the latent image carrier and also drives, the developing unit to supply the developer to the latent image carrier. The image forming apparatus further includes a controller for sequence-controlling the driving unit, the charging unit and the developing unit so that the application of the developing bias voltage to the developing unit is started a predetermined time after the rotation of the latent image carrier and the drive of the developing unit and also the charging operation of the charging unit have been started.

Since the image forming apparatus is provided with the controller that starts the application of the developing bias voltage to the developing unit a predetermined time after the rotation of the latent image carrier and the charging operation of the charging unit have been started, the bias voltage of the developing unit is zero relative to the above-described uncharged region of the latent image carrier, and it is therefore possible to prevent adhesion of a charged toner to the uncharged region at the developing unit. Accordingly, it is possible to minimize the amount of unnecessary toner adhering to the latent image carrier in the early stage of printing process without the need for providing a mechanism for bringing the developing unit into and out of contact with the latent image carrier. Thus, the present invention can contribute to lowering of the runningcost and minimize the amount of waste toner, which is favorable from the environmental point of view.

In addition, the present invention provides an image forming apparatus including an endless latent image carrier, and a charging unit for charging the latent image carrier. A latent image forming unit forms a latent image on the latent image carrier charged. A developing unit develops the latent image formed on the latent image carrier with a developer by supplying the developer to the latent image carrier under application of a developing bias voltage. A transfer unit transfers the image developed on the latent image carrier to a sheet. A first driving unit rotates the latent image carrier. A second driving unit drives the developing unit to supply the developer to the latent image carrier. The image forming apparatus further includes a controller for sequence-controlling the first driving unit, the charging unit, the developing unit and the second driving unit so that the drive of the developing unit and the application of the developing bias voltage to the developing unit are started a predetermined time after the rotation of the latent image carrier and the charging operation of the charging unit have been started.

Since the image forming apparatus is provided with the controller that starts the application of the developing bias voltage to the developing unit a predetermined time after the rotation of the latent image carrier and the charging operation of the charging unit have been started, the bias voltage of the developing unit is zero relative to the above-described uncharged region of the latent image carrier, and it is therefore possible to prevent adhesion of a charged toner to the uncharged region at the developing unit. Accordingly, it is possible to minimize the amount of unnecessary toner adhering to the latent image carrier in the early stage of printing process without the need for providing a mechanism for bringing the developing unit into and out of contact with the latent image carrier. Thus, the present invention can contribute to lowering of the running cost and minimize the amount of waste toner, which is favorable from the environmental point of view.

Furthermore, there is a possibility of the developer adhering to the uncharged region when the developing unit is driven to supply the developer to the latent image carrier even if no developing bias is applied thereto. Therefore, the drive of the developing unit is started simultaneously with the application of the developing bias voltage, thereby preventing the developer from being supplied to the uncharged region. Accordingly, toner that can adhere to the uncharged region is limited to the toner present on a part of the developing unit that faces the uncharged region of the latent image carrier. Thus, it is possible to further minimize the amount of unnecessary toner adhering to the latent image carrier in the early stage of printing process.

Other features and advantages of the present invention will become readily apparent from the following description taken in conjunction with the accompanying drawings.

BRIEF DESCRIPTION OF THE DRAWINGS

The accompanying drawings, which are incorporated in and constitute a part of the specification, illustrate presently preferred embodiments of the invention, and together with the general description given above and detailed description of the preferred embodiments given below, serve to explain the principle of the invention.

DETAILED DESCRIPTION OF THE PREFERRED EMBODIMENTS

Figure 1A:
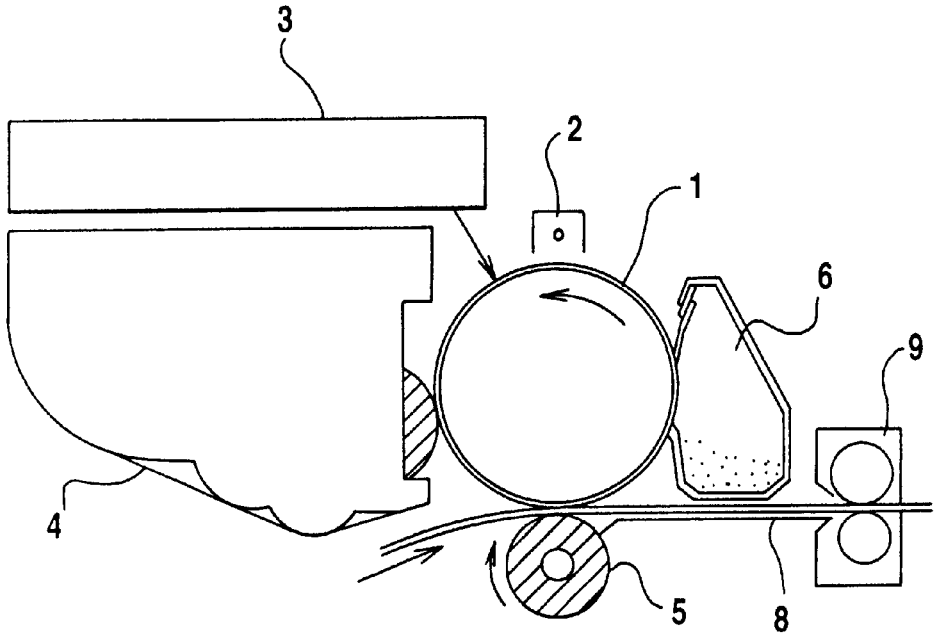
FIG.1A PRIOR ART
FIGS. 1A and 1B illustrate a conventional image forming apparatus.
Figure 1B:
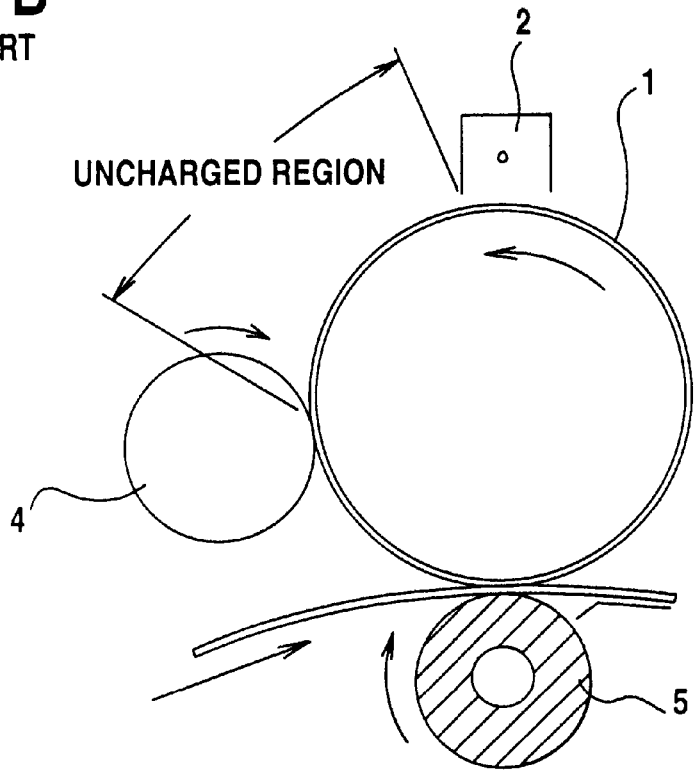
FIG.1B PRIOR ART
Figure 3A:
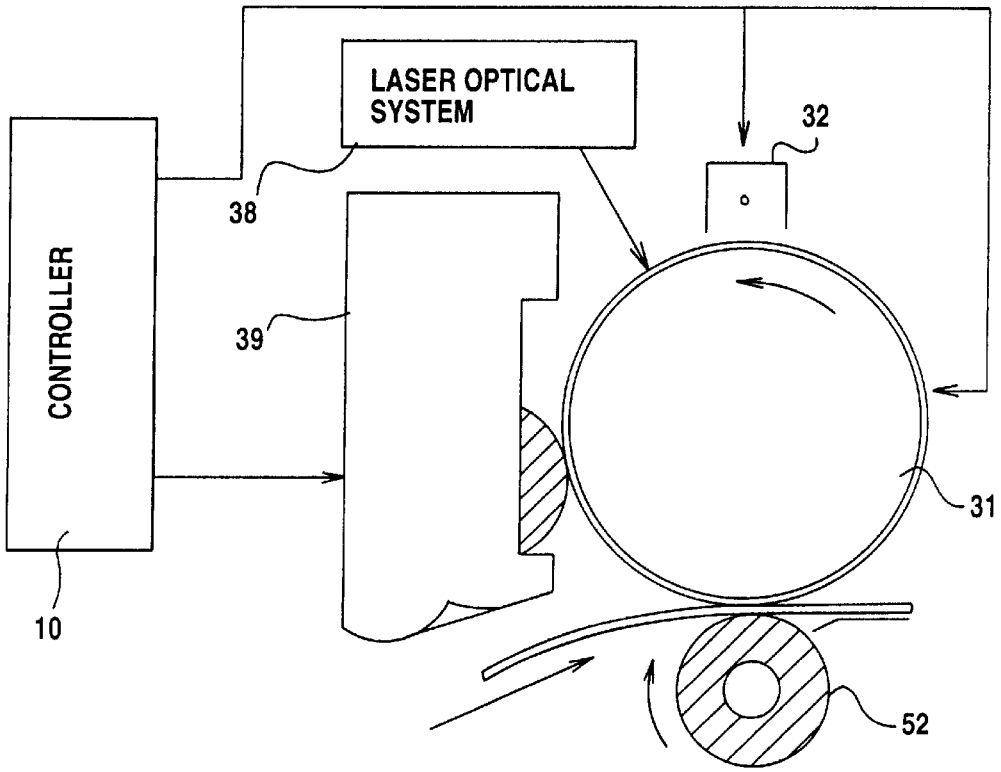
FIGS. 3A and 3B illustrate the principle of the present invention.
Figure 3B:
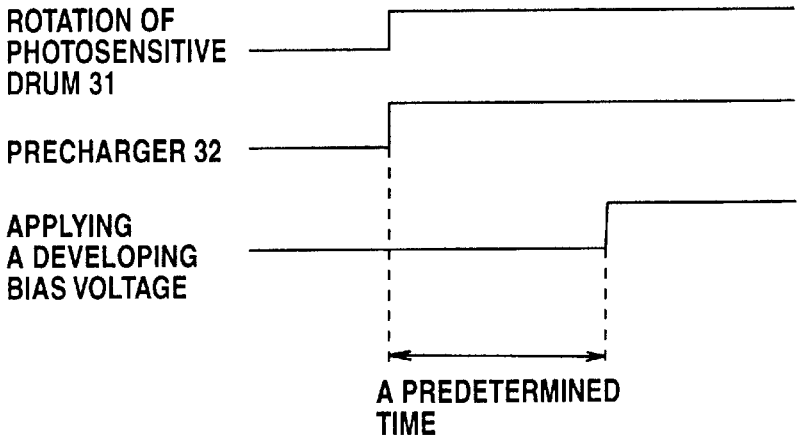

First, the principle of the present invention will be described with reference to FIGS. 3A and 3B. As shown in FIG. 3A, the image forming apparatus of the present invention is provided with a controller 10 for controlling the rotation of a photosensitive drum 31, the charging operation of a charger 32, the exposure operation of a laser optical system 38, and the operation of a developing unit 39. As shown in FIG. 3B, the controller 10 controls these constituent elements such that a developing bias voltage is applied to the developing unit 39 a predetermined time after the rotation of the photosensitive drum 31 and the charging operation of the charger 32 have been started. Thus, the developing bias voltage is applied after an uncharged region of the photosensitive drum 31 has passed the developing unit 39 by the rotation of the photosensitive drum 31, as shown in FIG. 1B. Accordingly, the toner in the developing unit 39 does not positively adhere to the uncharged region.

Figure 2A:
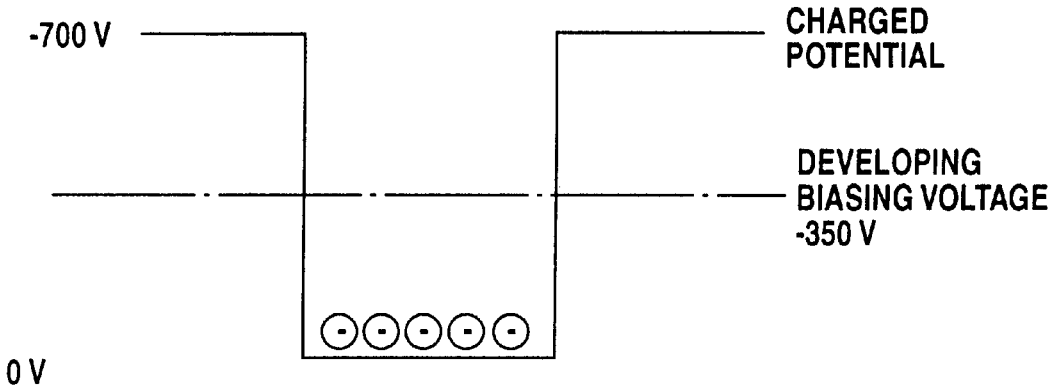
FIG.2A PRIOR ART
FIG. 2A is a view for explanation of a developing operation in which a developing bias is applied during developing process.
Figure 2B:
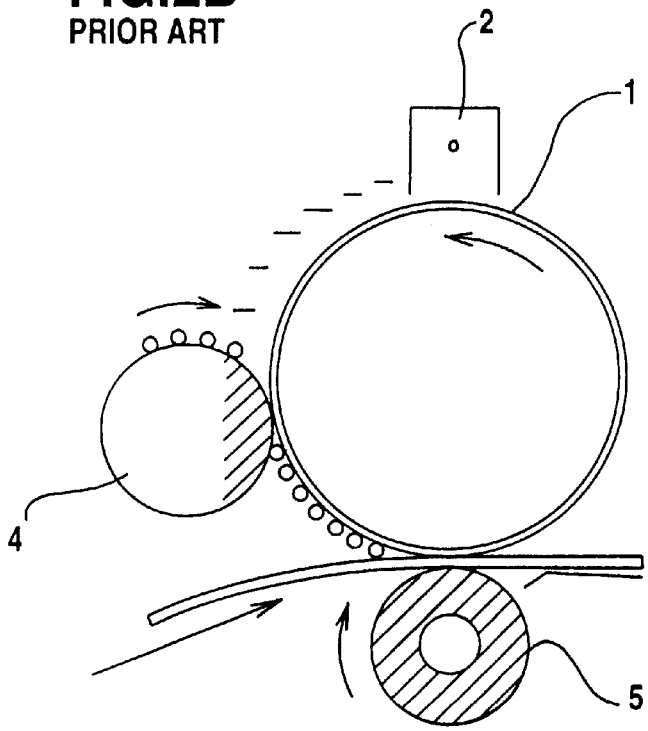
FIG.2B PRIOR ART
FIG. 2B is a view for explanation of a problem experienced with the prior art.

Thus, it is possible to prevent adhesion of toner to the uncharged region as shown in FIG. 2B and hence possible to avoid unnecessary consumption of toner and eliminate the need for collection of unnecessary toner.

Figure 4:
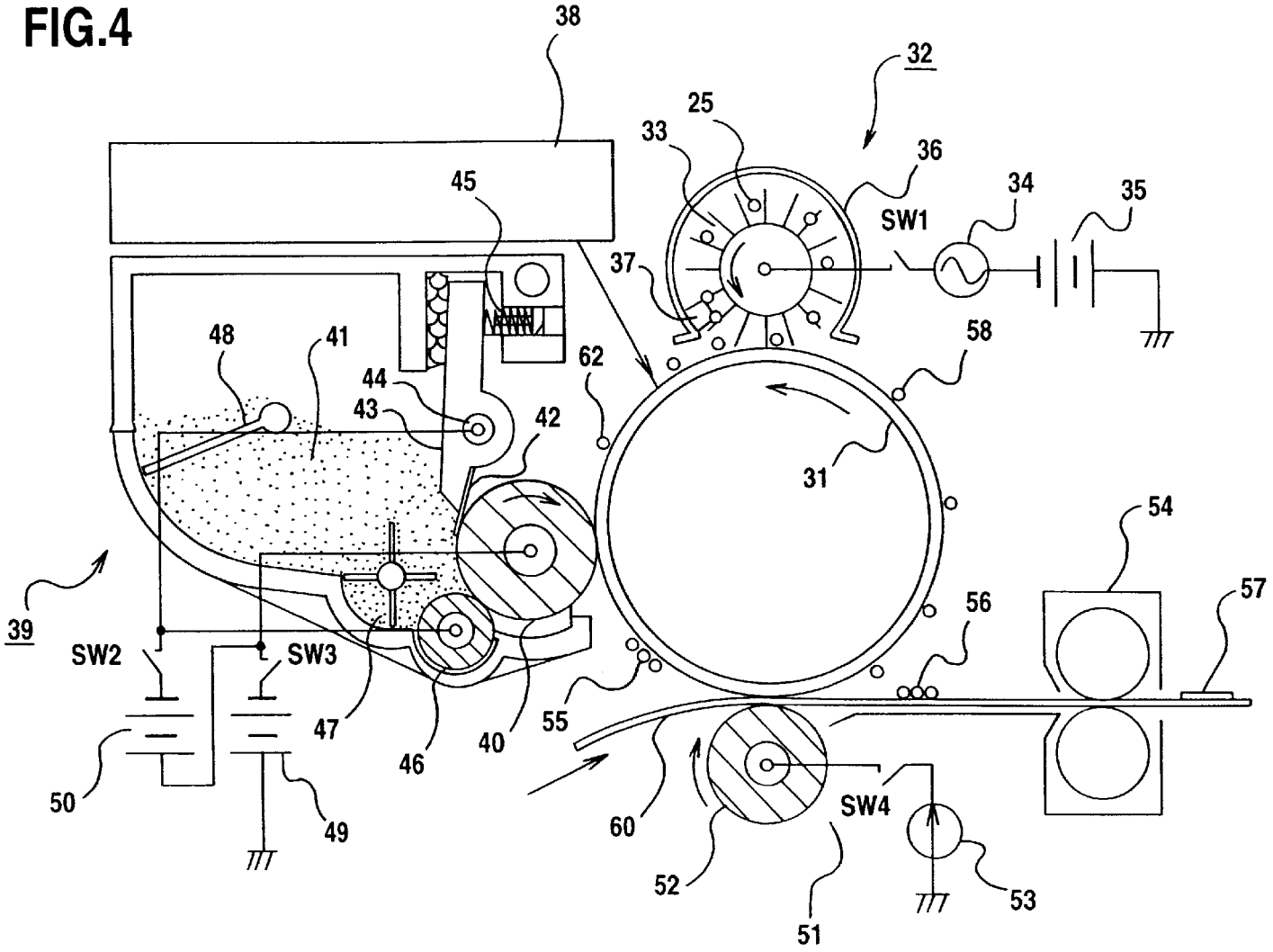
FIG. 4 illustrates the arrangement of one embodiment of the image forming apparatus according to the present invention.

Next, the arrangement of the image forming apparatus will be explained. FIG. 4 illustrates the arrangement of one embodiment of the present invention in which the invention is applied to a cleanerless electrophotographic printer. FIGS. 5A, 5B, 6A and 6B show the arrangement of a transfer roller moving mechanism employed in the embodiment shown in FIG. 4.

Referring to FIG. 4, a photosensitive drum 31 has a double-layered organic photoconductive material coated to a thickness of about 20 microns on an aluminum drum. The photosensitive drum 31 has an outer diameter of 40 mm and rotates counterclockwise as shown by the arrow at a peripheral speed of 70 mm/sec. A rotary brush charger 32 has an electrically conductive fur brush (charging brush) 33 which is in contact with the surface of the photosensitive drum 31 and rotated counterclockwise, as shown by the arrow, by a rotational drive source (not shown), an AC power source 34 connected to the charging brush 33, a DC constant-voltage source 35, and a housing 36 for covering the rotating charging brush 33 to prevent scattering of toner. The charger 32 further has a projection 37 provided at an exit of the housing 36. The projection 37 is adapted to collide with the rotating charging brush 33 so as to remove the toner from the charging brush 33 and drop it onto the photosensitive drum 31.

The charging brush 33 is a roll of a belt-shaped, raised base fabric spirally wound around the outer periphery of a stainless steel shaft as a base without a gap between each adjacent turns of the fabric. Accordingly, the charging brush 33 has a brush fiber layer around the stainless steel shaft. In this embodiment, the thickness of the brush fiber layer is set at 5 mm, and the charging brush 33 is arranged so that the outer diameter thereof is 16 mm. The brush fibers are endowed with electrical conductivity by dispersing carbon particles into rayon fibers. The resistance of the brush fibers is selected to be 109 ohm per fiber. The rotational speed of the charging brush 33 is set at 1.6 times that of the photosensitive drum 31.

The DC constant-voltage source 35 is set at −700 V. The AC power source 34 is set so that the peak-to-peak voltage is 1200 V and the frequency is 800 Hz. These power sources are connected to the charging brush 33 through a switch SW1. Accordingly, the surface of the photosensitive drum 31 is charged to −700 V. A laser optical system 38 is of a known type in which the photosensitive drum 31 is subjected to image exposure by laser light in accordance with an image pattern, thereby forming an electrostatic latent image. The potential at the latent image area is in the range of from −50 V to −100 V.

A developing unit 39 employs a single-component developer. The developing unit 39 has a developing roller 40 which rotates about a metallic rotating shaft to thereby supply a non-magnetic, insulating toner 41 to the electrostatic latent image formed on the photosensitive drum 31. The toner 41 has a volume resistivity of 4×1014 ohmcm, and an average particle diameter of 11 microns. The toner 41 has silica added thereto at a rate of 0.5%.

The developing roller 40 is formed using a porous urethane sponge (Rubicell, trade name, manufactured by Toyo Polymer Co., Ltd.) having a mean pore opening of 10 microns, a volume resistivity of 104 to 107 ohmcm and a hardness of about 30 degrees (Asker C hardness tester). The outer diameter of the developing roller 40 is set at 20 mm, and the peripheral speed thereof is set at 2.5 times that of the photosensitive drum 31.

A layer thickness regulating blade 42 is a stainless steel plate of 0.1 mm in thickness having the distal end thereof subjected to round edge processing (R of the distal end portion is 0.05 mm). A blade holder 43 is pivotable about a pivot point 44. The layer thickness regulating blade 42 is secured to the distal end of the blade holder 43. The proximal end of the blade holder 43 is subjected to a pressure applied by a coil spring 45 so that the distal end of the blade holder 43, together with the layer thickness regulating blade 42, is biased toward the developing roller 40. The pressure is set so that the layer thickness regulating blade 42 presses against the developing roller 40 at a pressure of 30 gf/cm.

A reset roller 46 removes and collects the toner remaining on the developing roller 40 after the development of the electrostatic latent image on the photosensitive drum 31 and also supplies the toner 41 to the developing roller 40. Thus, the reset roller 46 has an auxiliary function to make the layer thickness of toner 41 on the developing roller 40 uniform. The reset roller 46 is formed using an ester system urethane sponge ("Everlight SK-E", trade name, manufactured by Bridgestone Tire Co., Ltd.) having a volume resistivity of 104 ohmcm. The peripheral speed of the reset roller 46 is set at 228 mm/sec.

Paddle rollers 47 and 48 are adapted to move the toner 41 to the vicinities of the developing roller 40. The paddle rollers 47 and 48 are made of a resin material. A DC power source 49 applies a developing bias to the developing roller 40. The developing bias is set at −350 V, which is approximately middle between the surface potential of the photosensitive drum 31, i.e., −700 V, and the latent image potential (−50 V to −100 V). Another DC power source 50 applies a voltage to both the layer thickness regulating blade 42 and the reset roller 46. The applied voltage is set at −100 V so that a potential difference of 100 V is produced between the layer thickness regulating blade 42 and the developing roller 40 and between the reset roller 46 and the developing roller 40.

Thus, when the toner 41 passes through the area between the developing roller 40 and the layer thickness regulating blade 42, it is charged by friction occurring between the same and the layer thickness regulating blade 42. In addition, an electric charge is injected into the toner 41 from the layer thickness regulating blade 42 by virtue of the presence of a potential difference between the developing roller 40 and the layer thickness regulating blade 42. Accordingly, the toner 41 is given an electric charge by both frictional charging and charge injection. Therefore, the amount of charge carried by the toner 41 only slightly depends on environmental conditions, so that a uniform toner layer can be stably formed on the developing roller 40 for a long period of time.

It should be noted that under the above-described process conditions the toner 41 is negatively charged, and the potential difference between the reset roller 46 and the developing roller 40 functions so as to electrically supply the negatively charged toner 41 to the developing roller 40.

The developing unit 39 having the above-described arrangement is pressed against the photosensitive drum 31 under a pressure of 30 gf/cm.

A roller transfer unit 51 has a transfer roller 52 formed by providing an electrically conductive foam of the same material as that of the developing roller 40 around a stainless steel shaft as an electrically conductive elastic layer by lining process. The outer diameter of the transfer roller 52 is set at 20 mm. The transfer roller 52 is rotated at the same peripheral speed as that of the photosensitive drum 31 and pressed toward the photosensitive drum 31 at a pressure of 30 gf/cm by a pressing mechanism as shown in FIGS. 5 and 6. A constant-current source 53 is connected to the transfer roller 52 through a switch SW4 to supply a constant current to the transfer roller 52, thereby supplying a predetermined electric charge to a sheet of paper 60.

The constant-current source 53 causes the transfer roller 52 to produce an electric charge opposite in polarity to the charge carried by the toner in order to electrostatically transfer the toner image on the photosensitive drum 31 to the sheet 60. Since the toner 41 employed in this embodiment is a negative toner, a positive bias is applied to the transfer roller 52. The electrostatic transfer is combined with pressure transfer that is effected by pressing the transfer roller 52 against the photosensitive drum 31. A fixing unit 54 heats the toner image by a thermal roller incorporating a halogen lamp to thereby fix the toner image to the sheet 60.

The image forming operation of this embodiment will be explained below. The surface of the photosensitive drum 31 is uniformly charged to −700 V by the brush charger 32 and then subjected to image exposure by the laser optical system 38. Thus, an electrostatic latent image in which the background portion is at −700 V and the exposed portion is in the range of from −50 V to −100 V is formed on the photosensitive drum 31. The electrostatic latent image is developed to a toner image 55 with the spherical polymerization toner 41, which has been precharged negatively, at the single-component developing unit 39. Thereafter, the toner image 55 is transferred to the sheet 60 with the pressure and electrostatic force by the roller transfer unit 51.

At this time, even if the printing process is carried out under high-humidity conditions, the transfer efficiency will not lower partly because the transfer roller 52 functions as an electrode which is held in close contact with both the sheet 60 and the toner image 55 and partly because the transfer process employs both electrostatic transfer and pressure transfer. The toner image 56 on the sheet 60 is fixed thereto by the fixing unit 54.

Meantime, the toner 58 remaining on the photosensitive drum 31 after the transfer process is removed from the photosensitive drum 31 by the rotation of the charging brush 33 of the brush charger 32 and charged to adhere to the photosensitive drum 31 again. At this time, since the photosensitive drum 31 is charged with the residual toner 58 removed therefrom, unevenness of charging of the photosensitive drum 31 is eliminated. In addition, since the toner is removed from the photosensitive drum 31 by the charging brush 33, the toner locally remaining on the photosensitive drum 31 is effectively scattered. Further, since the toner carried by the charging brush 33 is dispersedly dropped on the photosensitive drum 31 by the action of the projection 37, collection of toner at the developing unit 39 is facilitated. Accordingly, it becomes unnecessary to provide a dispersing brush, which would otherwise be needed for the cleanerless process.

Thereafter, image exposure is effected by the laser optical system 38 to form a latent image in the same way as the above. Then, while collecting the residual toner, the developing unit 39 develops the latent image to a toner image. Since the residual toner collecting operation of the developing unit 39 is well known from, for example, the Journal of the Japan Society of Electrophotography Vol.30, No.3, pp.293–301, "Cleanerless Laser Printer Using Single-Component Non-Magnetic Development", description thereof is omitted.

The image forming apparatus, arranged as described above, does not employ corona discharge for charging and transfer and hence does not generate ozone, which is harmful to the human body. Thus, the apparatus is superior from the environmental point of view. In addition, no cleaner is provided, but the residual toner on the photosensitive drum 31 is collected at the developing unit 39 and reused. Accordingly, no waste toner occurs. It is therefore possible to lower the running cost and to eliminate the environmental problem otherwise caused by waste toner. Moreover, since no large-sized cleaner is needed, it is possible to reduce the overall size of the apparatus.

Figure 5A:
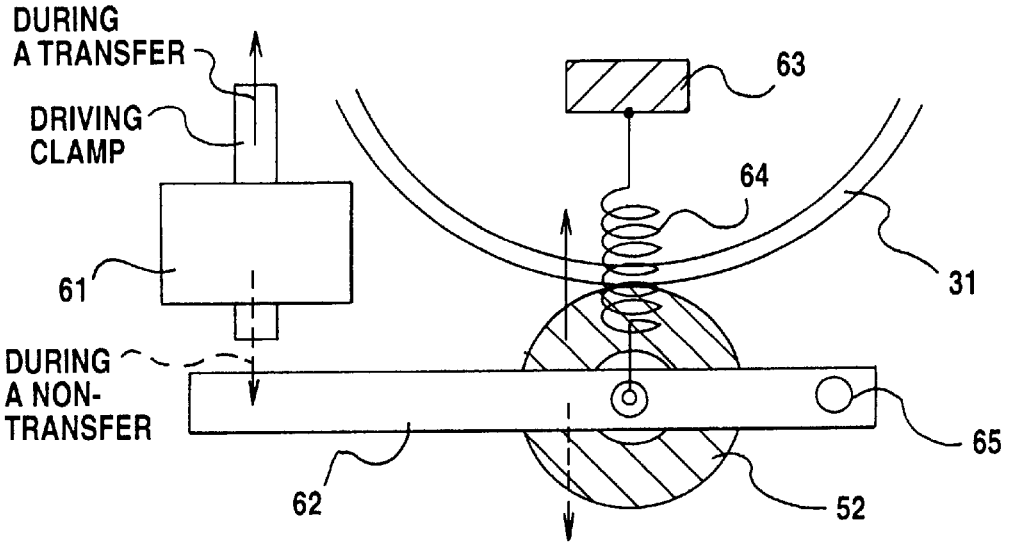
FIG. 5A illustrates the arrangement of one example of a transfer roller moving mechanism employed in the embodiment.

Next, a mechanism for bringing the transfer roller 52 into and out of contact with the photosensitive drum 31 (this mechanism will hereinafter be referred to as "transfer roller moving mechanism") will be explained with reference to FIGS. 5A, 5B, 6A and 6B. FIG. 5A shows the arrangement of one example of the transfer roller moving mechanism. The transfer roller 52 is attached to a clamp 62 which is pivotable about a fixed pivot point 65. The clamp 62 is actuated at an end portion thereof opposite to the pivot point 65 by a drive source 61, e.g. a solenoid.

In the illustrated example, when the drive source 61 is driven in the direction of the solid-line arrow shown in the figure, the clamp 62 is pulled by a spring 64. Thus, the transfer roller 52 comes into contact with the photosensitive drum 31. The transfer roller 52 needs to apply a predetermined pressure to the photosensitive drum 31. Therefore, the spring 64 is provided in between a structural member (stationary member) 63 of the apparatus and the shaft of the transfer roller 52, thereby producing the required transfer pressure. The transfer roller 52 rotates following the rotation of the photosensitive drum 31.

On the other hand, when the drive of the drive source 61 is canceled, the driving clamp of the drive source 61 returns as shown by the chain-line arrow in the figure, pushing the clamp 62, and thus withdrawing the transfer roller 52 from the photosensitive drum 31.

Since the transfer roller 52 is brought into contact with the photosensitive drum 31 when the drive source 61 is activated (supplied with power), even if an unexpected accident, e.g., a power failure, occurs, the transfer roller 52 automatically withdraws from the photosensitive drum 31. There is therefore no possibility of the transfer roller 52 being held in contact with the photosensitive drum 31 for a long period of time. Contact of the transfer roller 52 with the photosensitive drum 31 for a long period of time would cause deformation of the transfer roller 52 or change of properties of the photosensitive drum 31, inviting degradation of the print quality.

Figure 5B:
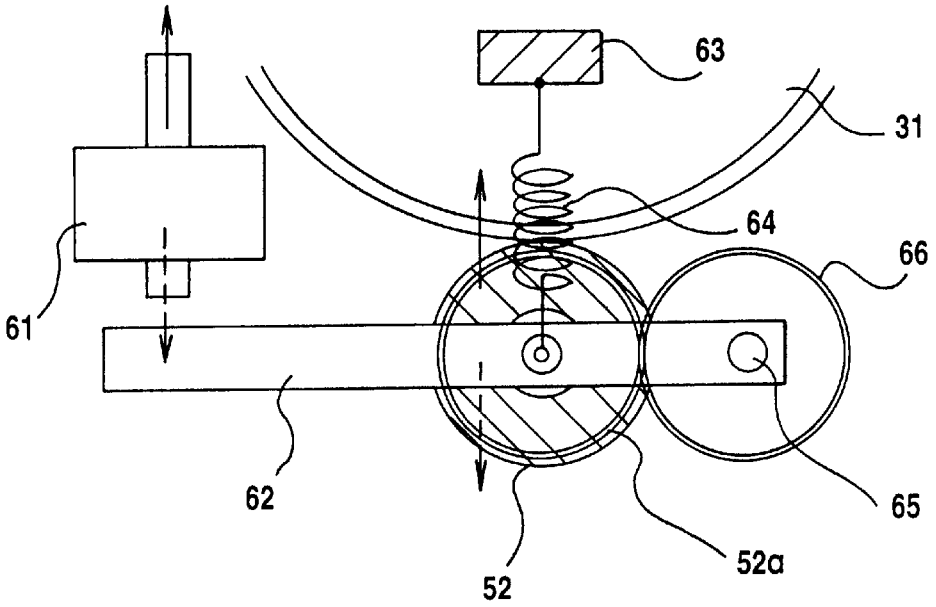
FIG. 5B illustrates the arrangement of a modification of the transfer roller moving mechanism.

FIG. 5B shows the arrangement of a modification of the transfer roller moving mechanism. In this modification, a gear 66 is provided on the pivot point 65 of the clamp 62 in addition to the arrangement shown in FIG. 5A. The gear 66 is in mesh with a gear 52*a* secured to the shaft of the transfer roller 52. The reason for this arrangement is as follows. In the roller transfer method, there is a case where the peripheral speed of the photosensitive drum 31 and that of the transfer roller 52 are made different from each other with a view to improving the transfer efficiency, and in such a case, rotational power must be externally transmitted to the transfer roller 52.

Therefore, power from a drive source (not shown) is transmitted to the gear 52*a* of the transfer roller 52 through the gear 66 attached to the pivot point 65, thereby rotating the transfer roller 52 at the desired peripheral speed. With this arrangement, the gear spacing does not change whether the transfer roller 52 is in the transfer position or in the non-transfer position. Therefore, therotational power can be stably transmitted to the transfer roller 52 at all times. It should be noted that the operation of bringing the transfer roller 52 into and out of contact with the photosensitive drum 31 is the same as in the arrangement shown in FIG. 5A.

Figure 6A:
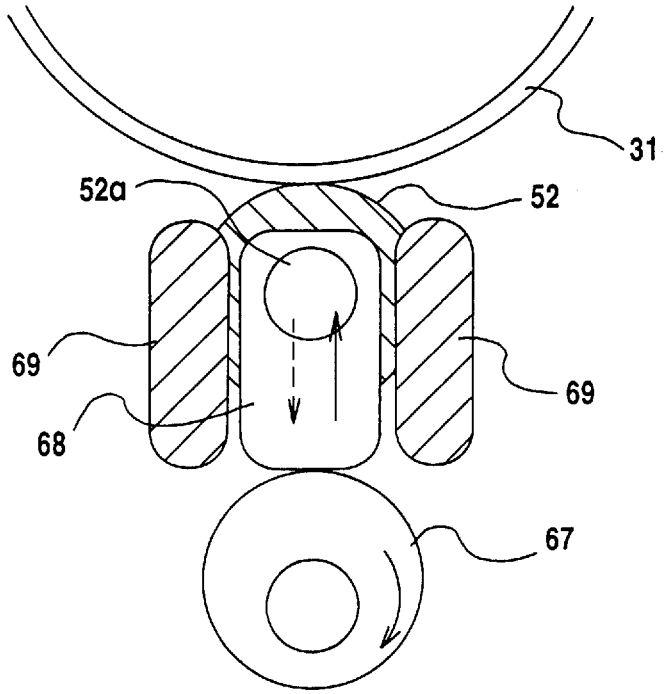
FIG. 6A illustrates the arrangement of another modification of the transfer roller moving mechanism.

FIG. 6A shows the arrangement of another modification of the transfer roller moving mechanism. In this modification, a slide member 68 is attached to the shaft 52*a* of the transfer roller 52. The slide member 68 is guided by a pair of guides 69 so as to be movable only in the vertical direction as shown by the arrows in the figure. In addition, an eccentric cam 67 is provided to move the slide member 68.

In this modification, by rotating the eccentric cam 67 one-half turn in the direction of the arrow, the slide member 68 is slid in the direction of the solid-line arrow shown in the figure, thereby bringing the transfer roller 52 into contact with the photosensitive drum 31, and thus setting the transfer roller 52 in its transfer position. The level of pressure with which the transfer roller 52 presses against the photosensitive drum 31 is determined by the spacing between the respective axes of rotation of the photosensitive drum 31 and the transfer roller 52 and the hardness of the transfer roller 52.

To bring the transfer roller 52 to its non-transfer position, the eccentric cam 67 is further rotated one-half turn. Consequently, the slide member 68 falls by gravity in the direction of the chain-line arrow shown in the figure, thereby withdrawing the transfer roller 52 from the photosensitive drum 31.

Figure 6B:
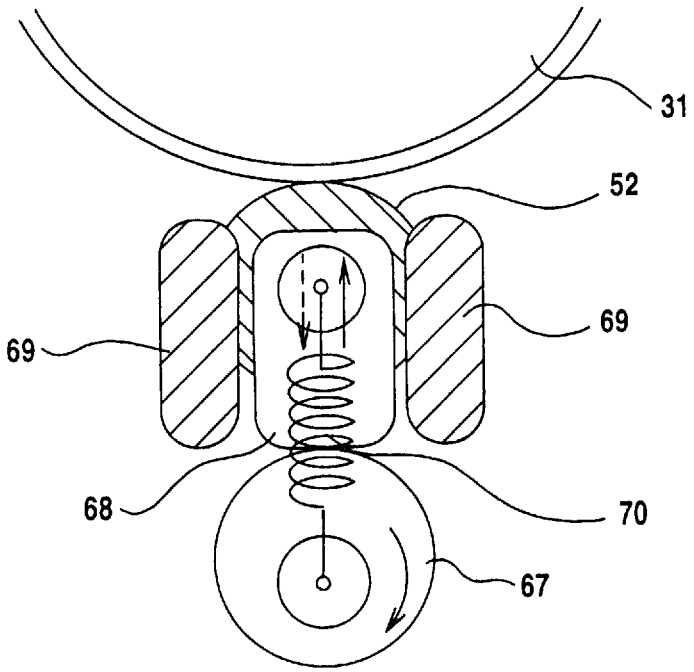
FIG. 6B illustrates the arrangement of still another modification of the transfer roller moving mechanism.

FIG. 6B shows the arrangement of still another modification of the transfer roller moving mechanism. In this modification, a return spring 70 is provided between the shaft 52*a* of the transfer roller 52 and the shaft of the eccentric cam 67 in addition to the arrangement shown in FIG. 6A. In this modification, during the shift of the transfer roller 52 to the non-transfer position in the modification shown in FIG. 6A, the transfer roller 52 is pulled downwardly by the action of the return spring 70, thereby enabling the transfer roller 52 to withdraw from the photosensitive drum 31 even more reliably.

Figure 7:
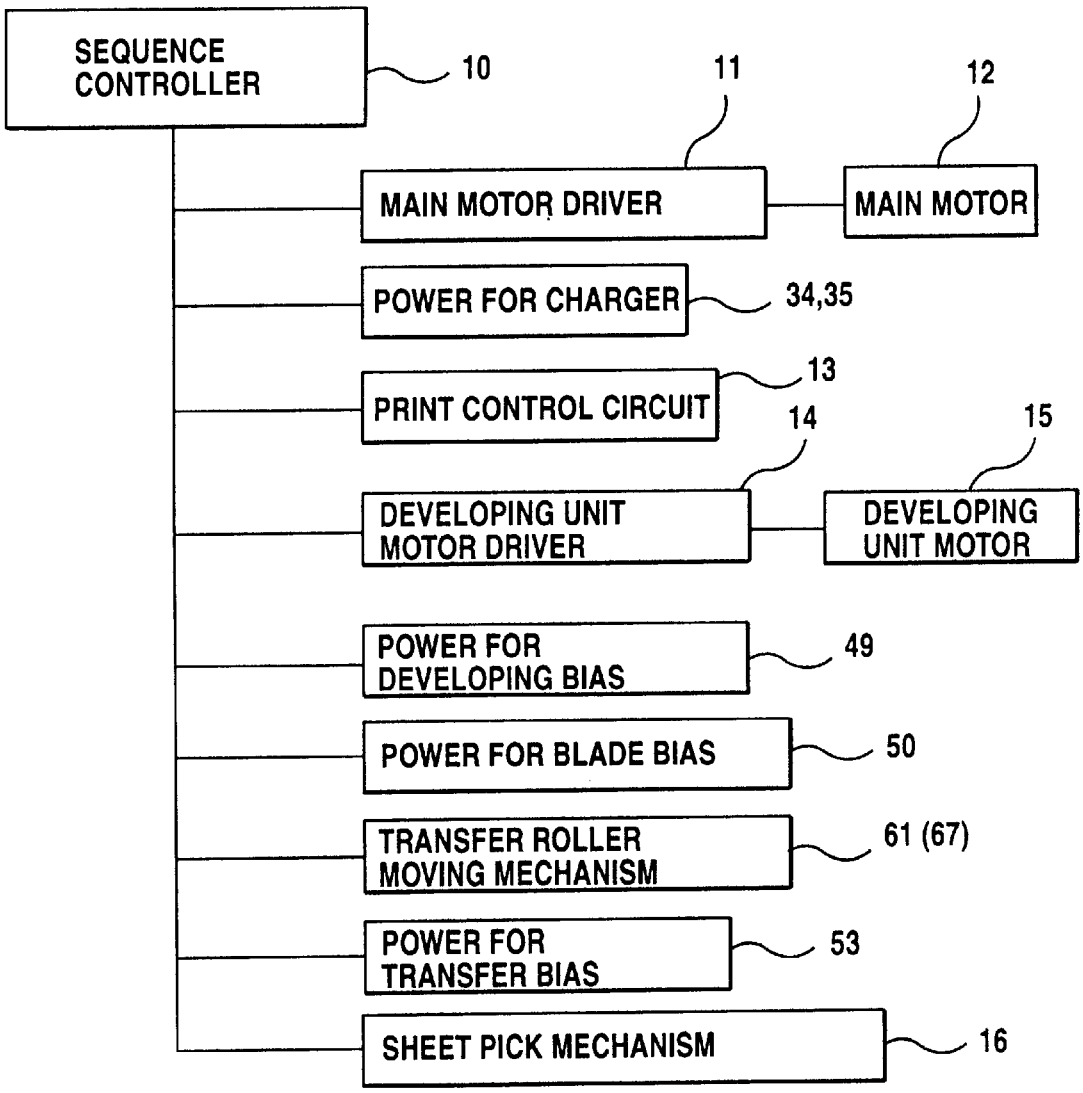
FIG. 7 is a block diagram of one embodiment of the present invention.

FIG. 7 is a block diagram of one embodiment of the present invention.

In the figure, a sequence controller 10 comprises a microprocessor (MPU) to effect sequence control of the image forming apparatus. A main motor driving circuit 11 drives a main motor of the apparatus under the control of the sequence controller (hereinafter referred to as "processor") 10. A main motor 12 rotates the photosensitive drum 31 and other rotary elements. The main motor 12 also drives the developing unit 39 in the case of a system having no developing unit motor.

The above-described charging power sources 34 and 35, together with the switch SW1, are ON/OFF controlled under the control of the processor 10. A print control circuit 13 controls the writing operation of the laser optical system 38 under the control of the processor 10. A developing unit motor driving circuit 14 drives a motor for driving the developing unit 39 under the control of the processor 10. A developing unit motor 15 rotates the developing roller 40, paddle rollers 47 and 48 and reset roller 46 of the developing unit 39.

The above-described developing bias voltage source 49 has a switch SW3 which is ON/OFF controlled by the processor 10. The blade bias voltage source 50 has a switch SW2 which is ON/OFF controlled by the processor 10. The transfer roller moving mechanism 61 brings the transfer roller 52 into and out of contact with the photosensitive drum 31 under the control of the processor 10.

The transfer bias voltage source 53 has a switch SW4 which is ON/OFF controlled by the processor 10. A sheet pickup roller driving mechanism 16 drives a pickup roller for delivering a sheet from a sheet cassette (not shown in FIG. 4).

Figure 8:
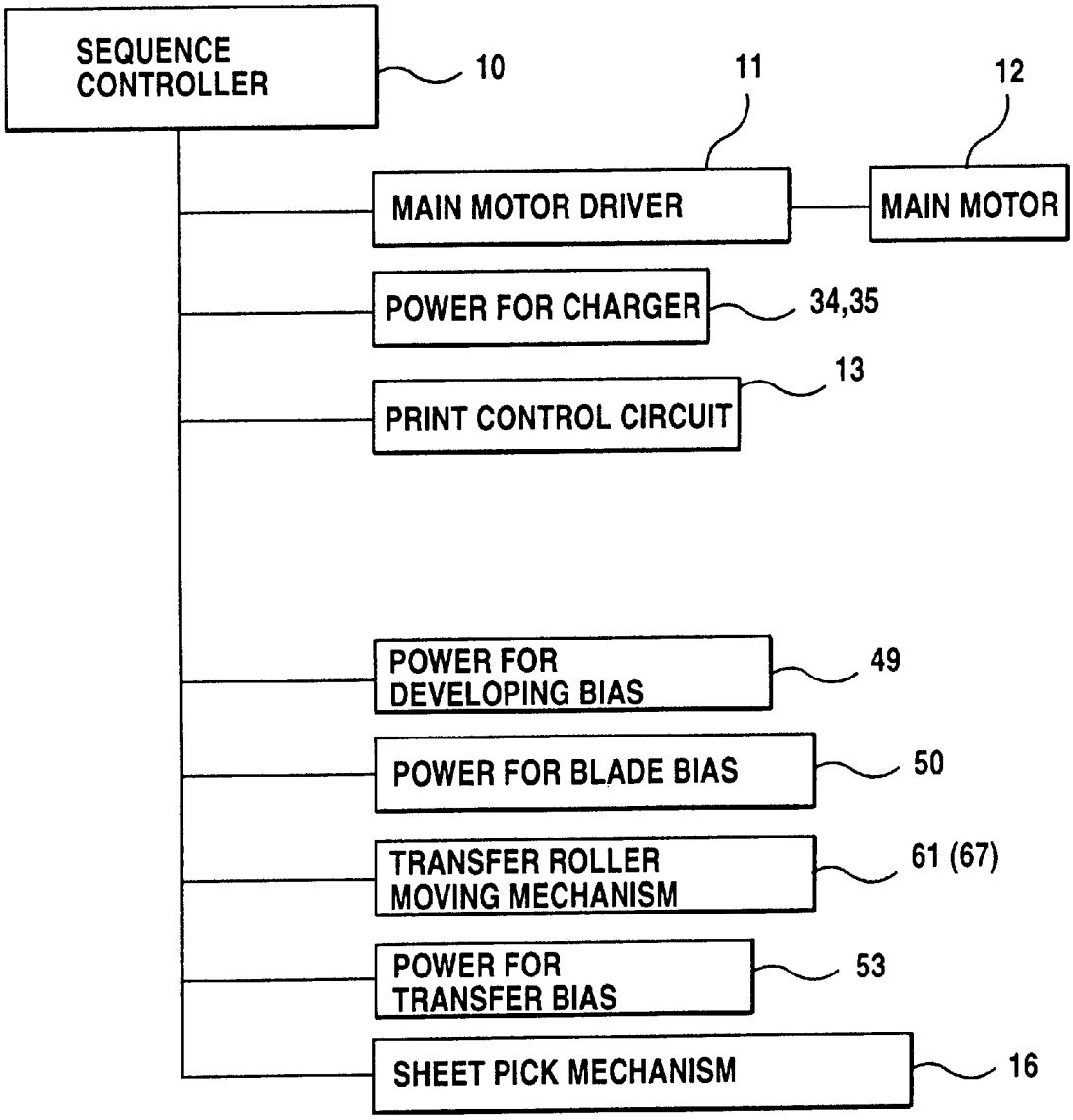
FIG. 8 is a block diagram of a modification of the present invention.

FIG. 8 is a block diagram of a modification of the present invention. In FIG. 8, the same elements as those shown in FIG. 7 are denoted by the same reference numerals. In this modification, the developing unit motor 15 is not provided, but the main motor 12 rotates the developing roller 40, paddle rollers 47 and 48 and reset roller 46 of the developing unit 39 instead, in addition to the photosensitive drum 31. The rest of the arrangement is the same as the arrangement shown in FIG. 7.

Figure 9:
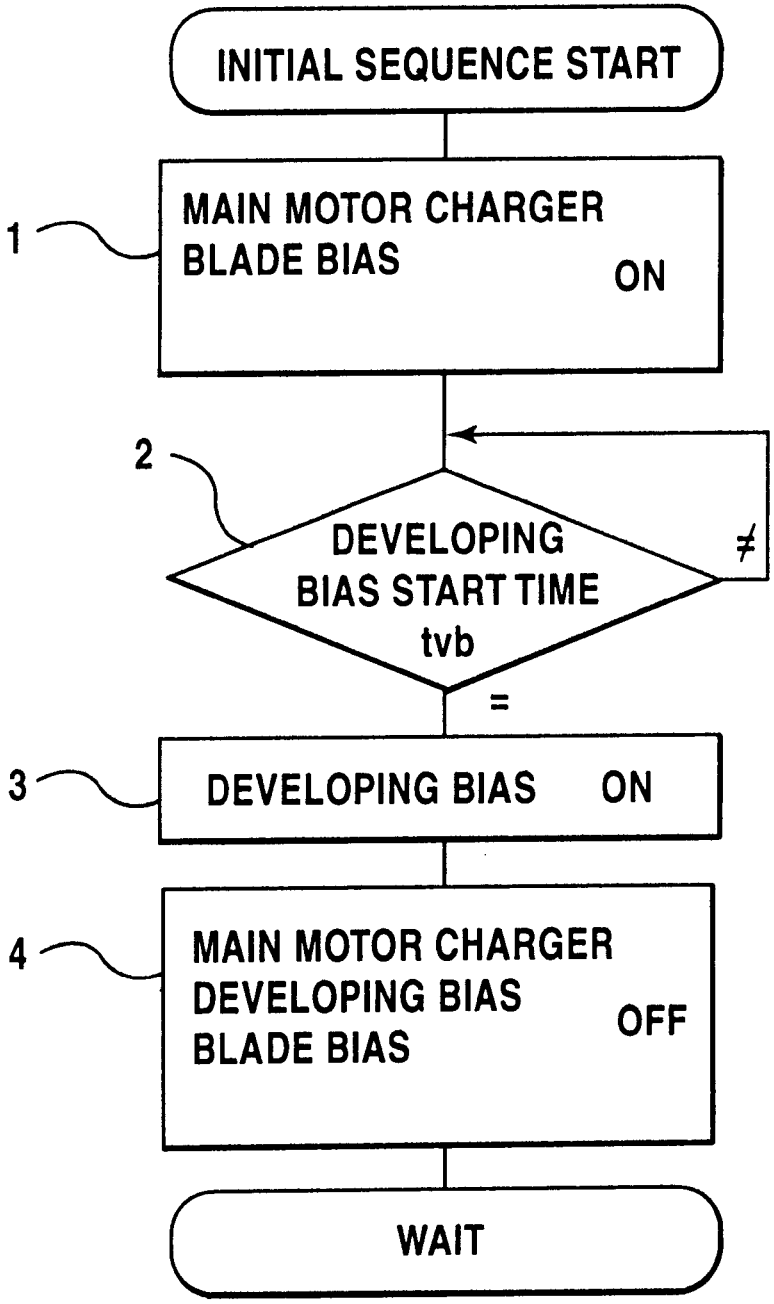
FIG. 9 is a flowchart showing initial processing according to a first embodiment of the present invention.
Figure 10:
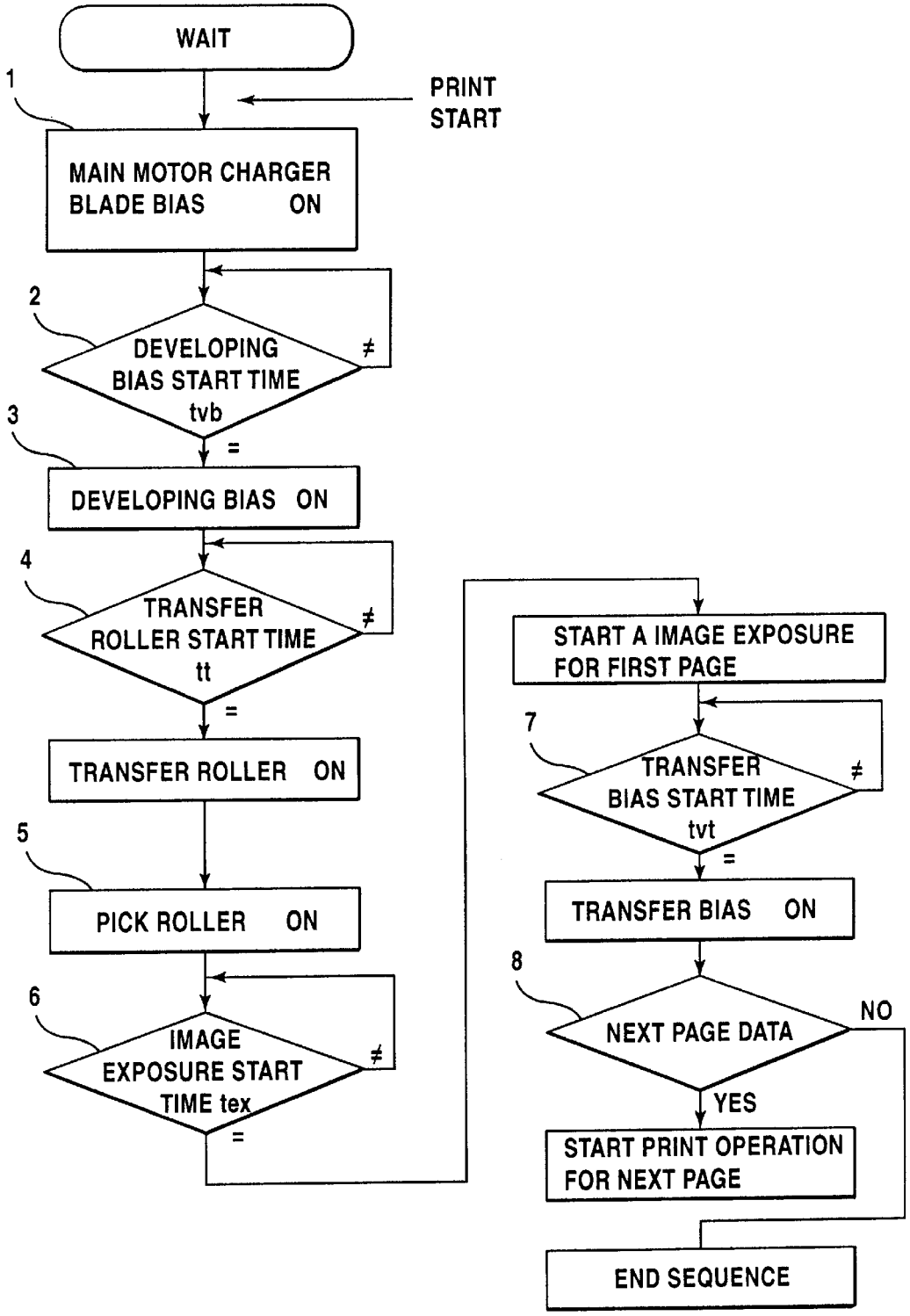
FIG. 10 is a flowchart showing printing processing according to the first embodiment of the present invention.
Figure 11:
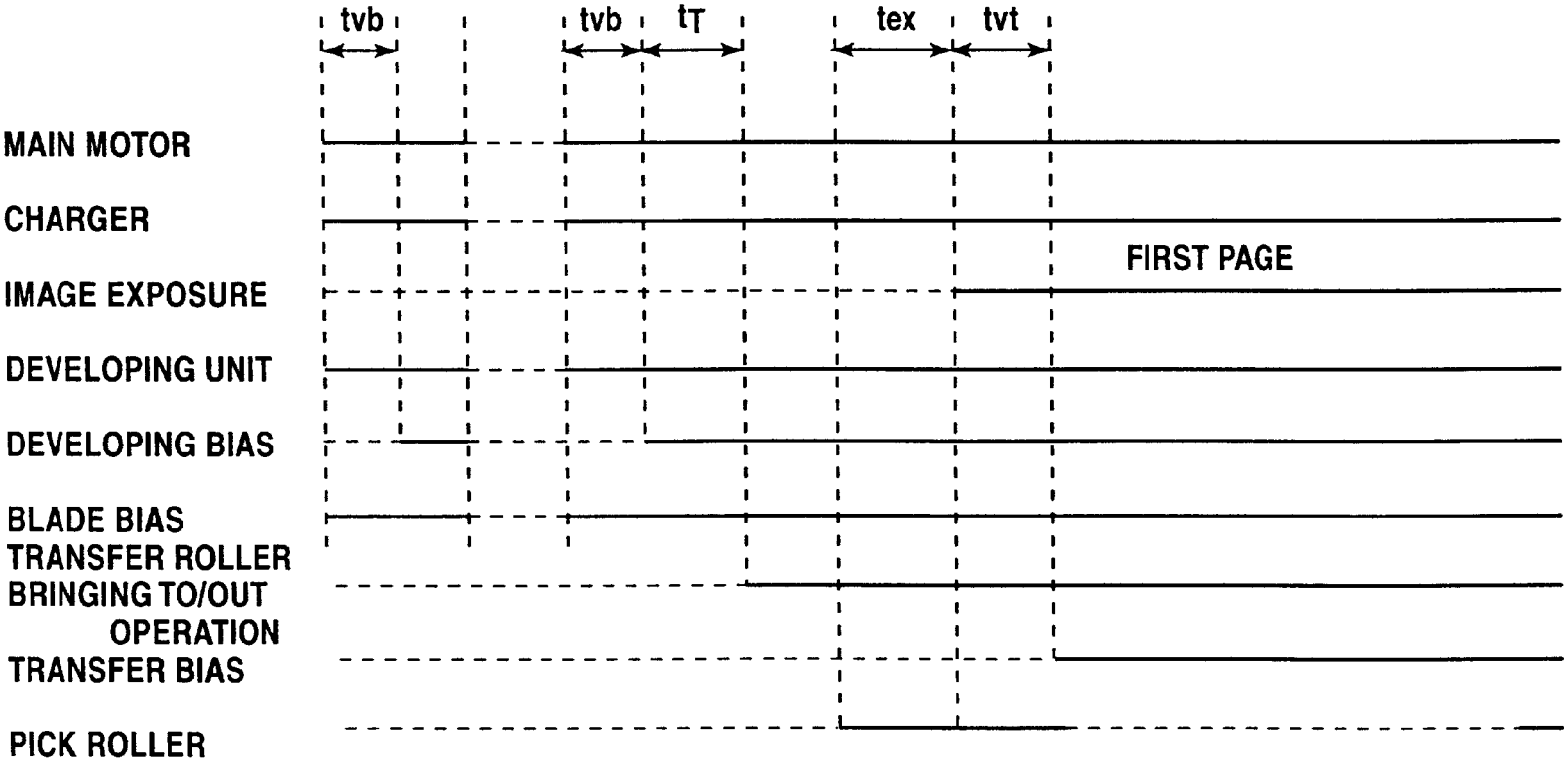
FIG. 11 is a timing chart of the processing operations shown in FIGS. 9 and 10.

FIG. 9 is a flowchart of initial processing according to a first embodiment of the present invention. FIG. 10 is a flowchart of printing processing according to the first embodiment of the present invention. FIG. 11 is a timing chart of the processing operations according to the first embodiment of the present invention. In this embodiment, the present invention is applied to the arrangement shown in the block diagram of FIG. 8. That is, no developing unit motor 15 is provided, but the main motor 12 drives both the photosensitive drum 31 and the developing unit 39. In addition, the transfer roller 52 can be brought into and out of contact with the photosensitive drum 31 by the action of the transfer roller moving mechanism 61.

The initial processing, which is executed before the printing processing shown in FIG. 10, will be explained below with reference to the flowchart of FIG. 9 and the timing chart of FIG. 11.

(1) When an initial operation is started, for example, by turning on the power supply, the processor 10 controls the main motor driving circuit 11 to drive the main motor 12. In this embodiment, the main motor 12 drives both the photosensitive drum 31 and the developing unit 39. In addition, the processor 10 turns on the charging bias voltage sources 34 and 35 and the switch SW1 to start charging. Further, the processor 10 turns on the blade bias voltage source 50 and the switch SW2 to apply a blade bias voltage (−100 V) to both the blade holder 43 and the reset roller 46.

Consequently, the photosensitive drum 31 rotates, and the charger 32 charges the photosensitive drum 31. At the developing unit 39, the developing roller 40 and other rollers rotate, and the blade 42 charges the toner by charge injection.

(2) The processor 10 starts the internal timer at the same time as it executes Step (1), and checks whether or not the timer value has reached a predetermined value. The predetermined value is a period of time tvb determined by adding a margin $\alpha$ to a period of time required for the photosensitive drum 31 to reach the developing position from the charger position. Accordingly, when the timer value indicates the time tvb, it means that the above-described uncharged region (see FIGS. 1B and 2B) of the photosensitive drum 31 has already passed the developing unit 39.

(3) When deciding that the timer value has reached the time tvb, the processor 10 turns on the developing bias voltage source 49 and the switch SW3 because the uncharged region of the photosensitive drum 31 has already passed the developing unit 39. Consequently, a developing bias voltage (−350 V) is applied to the developing roller 40, and a blade voltage (−450 V) is applied to both the blade 42 and the reset roller 46. As a result, a voltage of −100 V is applied between the developing roller 40 and the blade 42 and between the developing roller 40 and the reset roller 46.

(4) The processor 10 continues the operation for a predetermined initial time after the starting of the application of the developing bias voltage, for optimizing the toner charge and checking the system operation. When the predetermined initial time has elapsed, the processor 10 turns off the main motor 12, the charging bias voltage source for the charger 32 and the developing bias voltage source and blade bias voltage source for the developing unit 39 to terminate the initial processing. Thus, the system enters a stand-by state.

Thus, in the initial sequence that precedes a printing operation, the processor 10 activates the main motor 12, which also drives the developing unit 39, and the charger 32 and turns on the blade bias voltage source 50, and after the uncharged region of the photosensitive drum 31 has passed the developing unit 39, the processor 10 applies the developing bias voltage to the developing roller 40. Accordingly, it is possible to minimize the amount of toner adhering to the uncharged region at the developing unit 39.

In addition, the developing unit 39 is activated and the blade bias voltage is applied from the early stage of the operation of the system to thereby charge the toner on the developing roller 40. Therefore, when the uncharged region passes the developing unit 39, charging of the toner is stably effected, and hence occurrence of uncharged toner can be prevented. Thus, it is possible to prevent adhesion of uncharged toner to the uncharged region of the photosensitive drum 31 and hence possible to prevent adhesion of toner to the uncharged region at the developing unit 39 even more effectively.

Next, the printing processing operation will be explained with reference to FIG. 10.

(1) If a print command arrives when the system is in the stand-by state, a printing operation starts. First, the processor 10 controls the main motor driving circuit 11 to drive the main motor 12. In addition, the processor 10 turns on the charging bias voltage sources 34 and 35 and the switch SW1 to start charging. Further, the processor 10 turns on the blade bias voltage source 50 and the switch SW2 to apply a blade bias voltage (−100 V) to both the blade holder 43 and the reset roller 46.

Thus, the photosensitive drum 31 rotates, and the charger 32 charges the photosensitive drum 31. Further, at the developing unit 39, the developing roller 40 and other rollers rotate, and the blade 42 charges the toner by charge injection.

(2) The processor 10 starts the internal timer at the same time as it executes Step (1), and checks whether or not the timer value has reached a predetermined value. The predetermined value is a period of time tvb determined by adding a margin α to a period of time required for the photosensitive drum 31 to reach the developing position from the charger position. Accordingly, when the timer value indicates the time tvb, it means that the above-described uncharged region (see FIGS. 1B and 2B) of the photosensitive drum 31 has already passed the developing unit 39.

(3) When deciding that the timer value has reached the time tvb, the processor 10 turns on the developing bias voltage source 49 and the switch SW3 because the uncharged region of the photosensitive drum 31 has already passed the developing unit 39. Consequently, a developing bias voltage (−350 V) is applied to the developing roller 40. As a result, a voltage of −100 V is applied between the developing roller 40 and the blade 42 and between the developing roller 40 and the reset roller 46.

(4) The processor 10 starts the internal timer at the same time as it executes Step (3), and checks whether or not the timer value has reached a predetermined value. The predetermined value is a period of time tt determined by adding a margin α to a period of time required for the photosensitive drum 31 to reach the transfer position from the developing position. Accordingly, when the timer value indicates the time tt, it means that the above-described uncharged region (see FIGS. 1B and 2B) of the photosensitive drum 31 has already passed the transfer unit 51.

When deciding that the timer value has reached the time tt, the processor 10 activates the transfer roller moving mechanism 61 to bring the transfer roller 52 into contact with the photosensitive drum 31 because the uncharged region of the photosensitive drum 31 has already passed the transfer unit 51. Thus, since the transfer roller 52 is brought into contact with the photosensitive drum 31 after the uncharged region of the photosensitive drum 31 has passed the transfer unit 51, even if a slight amount of toner adheres to the uncharged region at the developing unit 39, there is no possibility of the toner in the uncharged region adhering to the transfer roller 52.

(5) The processor 10 activates the sheet pickup roller driving mechanism 16 to drive the pickup roller (not shown) to pick up a sheet from the sheet cassette (not shown) and feed it toward the transfer unit 51.

(6) In addition, the processor 10 starts the internal timer, and checks whether or not the timer value has reached a predetermined value. The predetermined value is a period of time tex determined by subtracting a period of time tvt required for the photosensitive drum 31 to reach the transfer unit position from the image exposure position from a period of time required for the sheet to reach the transfer unit position from the pickup position. That is, the predetermined time is a period of time required for the sheet to reach a position on the sheet feed path which is away from the transfer unit position by the distance from the image exposure position of the photosensitive drum 31 to the transfer unit position. Thus, the feed of the sheet and the image exposure are synchronized with each other.

When deciding that the timer value has reached the time tex, the processor 10 instructs the laser optical system 38 to start image exposure, thereby starting image exposure for one page.

(7) Next, the processor 10 starts the internal timer, and checks whether or not the timer value has reached a predetermined value. The predetermined value is a period of time tvt required for the photosensitive drum 31 to reach the transfer unit position from the image exposure position. When deciding that the timer value has reached the time tvt, the processor 10 turns on the transfer bias voltage source 53 and the switch SW4 to apply the transfer bias voltage to the transfer roller 52 because the toner image formed by the image exposure has reached the transfer position and the sheet has also reached the transfer position. Thus, the toner image on the photosensitive drum 31 is electrostatically and mechanically transferred to the sheet.

(8) Upon completion of the image exposure for the first page, the processor 10 makes a check for the arrival of data on the next page. If data on the next page arrives within a predetermined period of time, the processor 10 executes Steps (5) and so forth to start printing for the next page.

On the other hand, if no next page data is available, the processor 10 decides the printing to be terminated, and executes a termination sequence. The termination sequence includes an operation of turning off the main motor 12, the charging bias voltage source for the charger 32 and the developing bias voltage source and blade bias voltage source for the developing unit 39, an operation of withdrawing the transfer roller 52 from the photosensitive drum 31, and an operation of turning off the transfer bias voltage source.

Thus, the developing bias voltage application timing is delayed so that no developing bias voltage is applied when the uncharged region of the photosensitive drum 31 passes the developing unit 39, thereby preventing the toner from adhering to the uncharged region at the developing unit 39, which would otherwise occur by the application of the developing bias voltage.

The uncharged toner in the developing unit 39 may adhere to the uncharged region even if the developing bias voltage is not applied. To prevent the adhesion of the uncharged toner to the uncharged region, the developing unit 39 is activated and the blade bias voltage is also applied from the early stage of the operation of the system to thereby charge the toner in the developing unit 39. Thus, it is possible to minimize the amount of uncharged toner in the toner fed by the developing roller 40 and hence possible to prevent adhesion of the toner to the uncharged region even more effectively.

Furthermore, since the transfer roller 52 is brought into contact with the photosensitive drum 31 after the uncharged region has passed the transfer roller 52, even if a slight amount of toner adheres to the photosensitive drum 31 at the developing unit 39, it is possible to prevent the toner from adhering to the transfer roller 52 and hence possible to prevent the sheet from being stained with toner during printing process.

Figure 12:
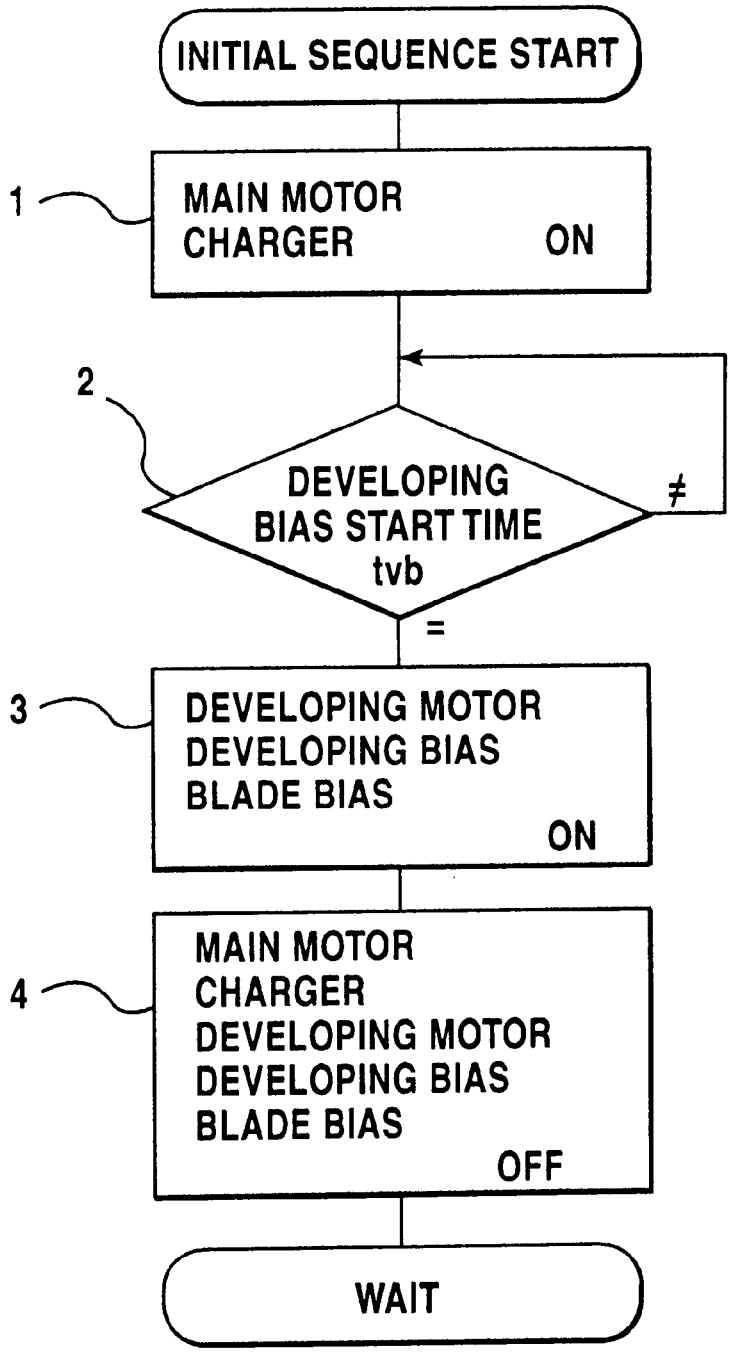
FIG. 12 is a flowchart showing initial processing according to a second embodiment of the present invention.
Figure 13:
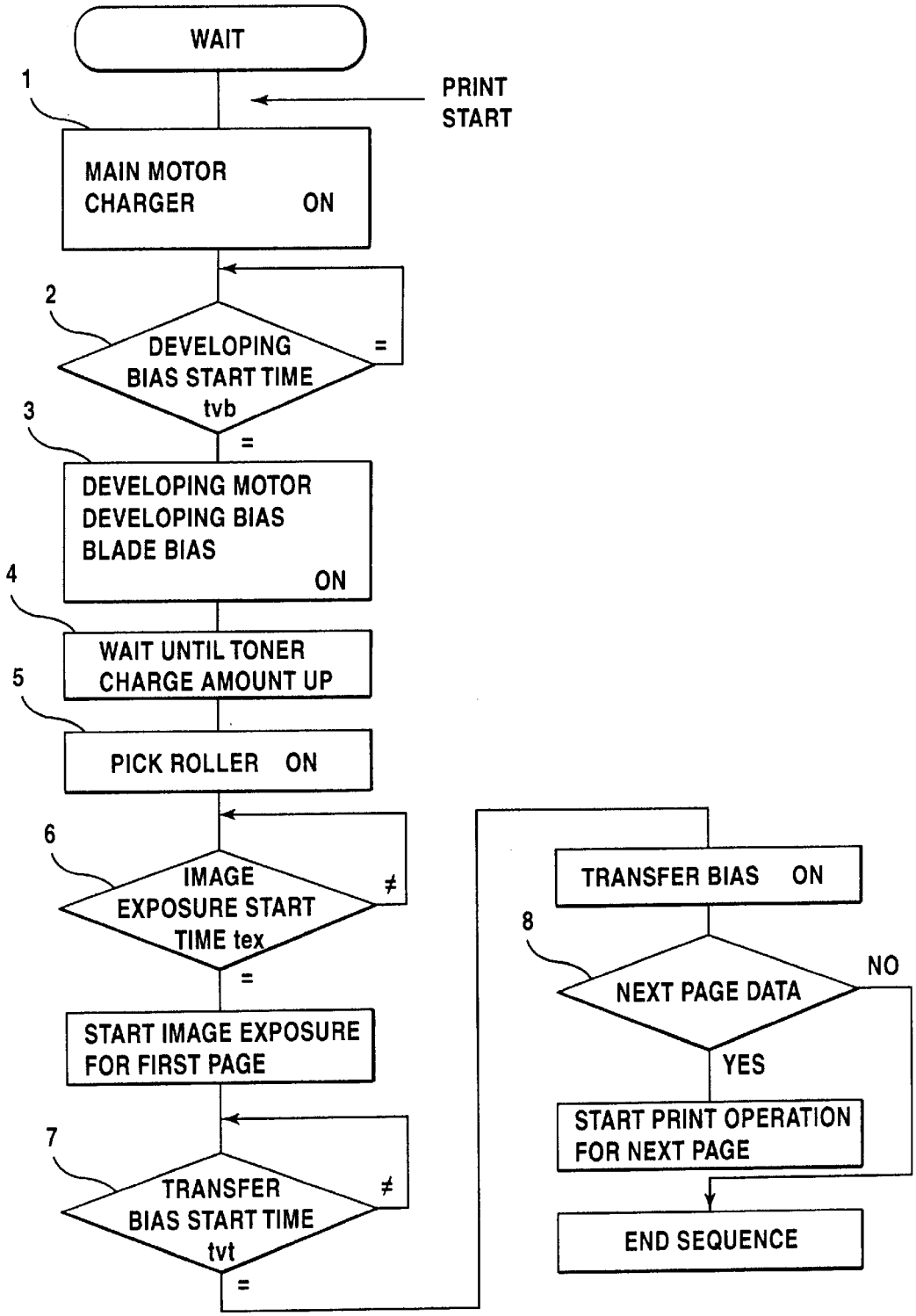
FIG. 13 is a flowchart showing printing processing according to the second embodiment of the present invention.
Figure 14:
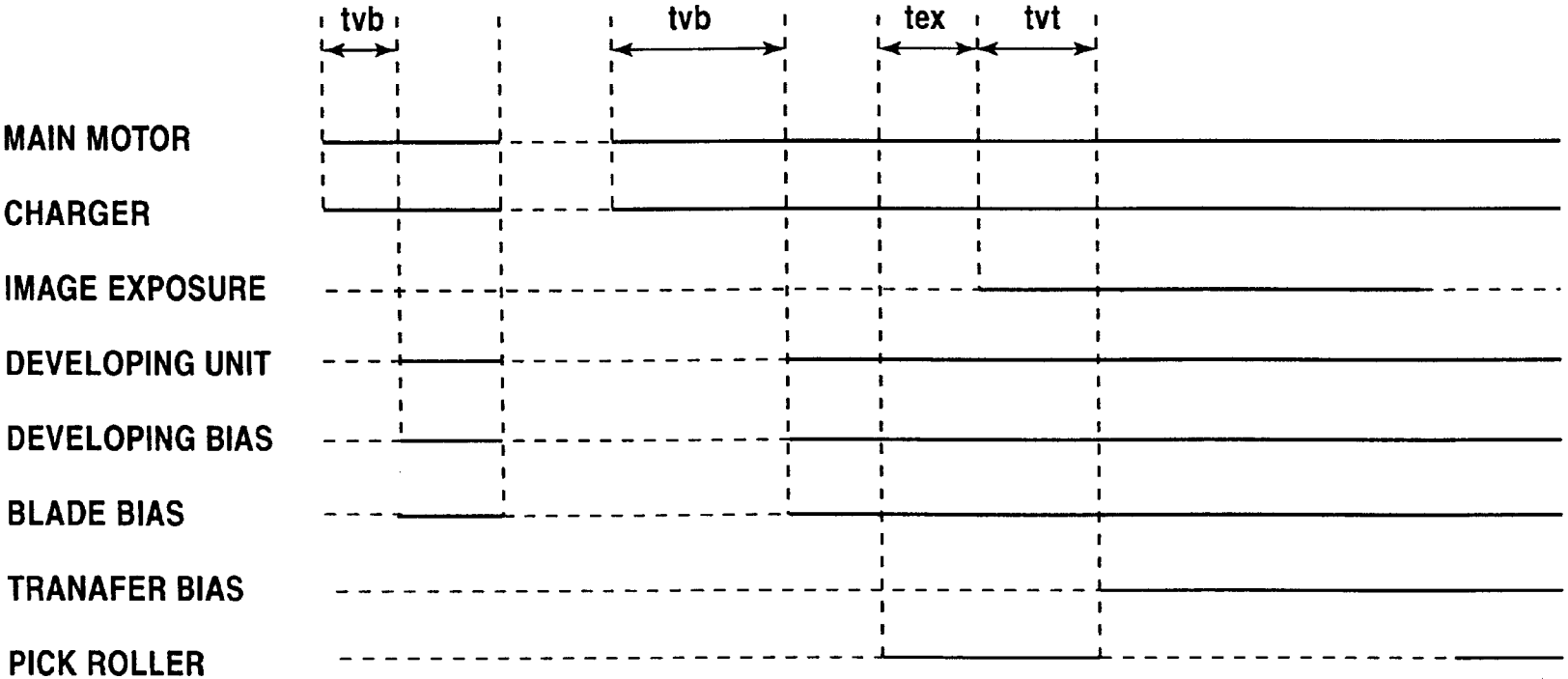
FIG. 14 is a timing chart of the processing operations shown in FIGS. 12 and 13.

FIG. 12 is a flowchart showing initial processing according to a second embodiment of the present invention. FIG. 13 is a flowchart showing printing processing according to the second embodiment of the present invention. FIG. 14 is a timing chart of the processing operations according to the second embodiment of the present invention. It should be noted that this embodiment is provided with the main motor 12 and the developing unit motor 15 for respective purposes as in the arrangement shown in FIG. 7, and that the image forming apparatus in this embodiment is of the type in which the transfer roller 52 is held in contact with the photosensitive drum 31 at all times without being withdrawn therefrom.

The initial processing, which is executed before the printing processing shown in FIG. 13, will be explained below with reference to the flowchart of FIG. 12 and the timing chart of FIG. 14.

(1) When the initial operation is started, for example, by turning on the power supply, the processor 10 controls the main motor driving circuit 11 to drive the main motor 12 to rotate the photosensitive drum 31. In addition, the processor 10 turns on the charging bias voltage sources 34 and 35 and the switch SW1 to start charging. Thus, the photosensitive drum 31 rotates, and the charger 32 charges the photosensitive drum 31. At this time, the developing roller 40 and other rollers in the developing unit 39 do not rotate.

(2) The processor 10 starts the internal timer at the same time as it executes Step (1), and checks whether or not the timer value has reached a predetermined value. The predetermined value is a period of time tvb determined by adding a margin $\alpha$ to a period of time required for the photosensitive drum 31 to reach the developing position from the charger position. Accordingly, when the timer value indicates the time tvb, it means that the above-described uncharged region (see FIGS. 1B and 2B) of the photosensitive drum 31 has already passed the developing unit 39.

(3) When deciding that the timer value has reached the time tvb, the processor 10 starts the developing unit motor 15 rotating through the developing unit motor driving circuit 14 and turns on the developing bias voltage source 49 and the switch SW3 because the uncharged region of the photosensitive drum 31 has already passed the developing unit 39. Further, the processor 10 turns on the blade bias voltage source 50 and the switch SW2 to apply a blade bias voltage (−100 V) to both the blade holder 43 and the reset roller 46. Thus, the developing roller 40 rotates with a developing bias voltage (−350 V) applied thereto, and a blade voltage (−450 V) is applied to both the blade 42 and reset roller 46, thereby enabling development to be effected.

(4) The processor 10 continues the operation for a predetermined initial time from the starting of the application of the developing bias voltage, for optimizing the toner charge and checking the system operation. When the predetermined initial time has elapsed, the processor 10 turns off the main motor 12 and the developing unit motor 15 and further turns off the charging bias voltage source for the charger 32 and the developing bias voltage source and blade bias voltage source for the developing unit 39 to terminate the initial processing, thus entering a stand-by state.

Thus, in the initial sequence that precedes a printing operation, the processor 10 starts the photosensitive drum 31 rotating and activates the charger 32, and after the uncharged region of the photosensitive drum 31 has passed the developing unit 39, the processor 10 drives the developing unit 39 and applies the developing bias voltage and blade bias voltage to the developing unit 39. Accordingly, it is possible to minimize the amount of toner adhering to the uncharged region at the developing unit 39.

Furthermore, in the early stage of the operation, the developing unit 39 is not in operation, and hence the developing roller 40 is not in rotation for feeding toner. Accordingly, only a part of the developing roller 40 is in contact with the uncharged region of the photosensitive drum 31, and only the toner present on the contact portion of the developing roller 40 can adhere to the uncharged region. It is therefore possible to prevent the adhesion of toner to the uncharged region at the developing unit 39 even more effectively.

Next, the printing processing operation will be explained with reference to FIG. 13.

(1) If a print command arrives when the system is in the stand-by state, a printing operation starts. First, the processor 10 controls the main motor driving circuit 11 to drive the main motor 12. In addition, the processor 10 turns on the charging bias voltage sources 34 and 35 and the switch SW1 to start charging. Thus, the photosensitive drum 31 rotates, and the charger 32 charges the photosensitive drum 31. On the other hand, at the developing unit 39, the developing roller 40 has not yet been rotated.

(2) The processor 10 starts the internal timer at the same time as it executes Step (1), and checks whether or not the timer value has reached a predetermined value. The predetermined value is a period of time tvb determined by adding a margin $\alpha$ to a period of time required for the photosensitive drum 31 to reach the developing position from the charger position. Accordingly, when the timer value indicates the time tvb, it means that the above-described uncharged region (see FIGS. 1B and 2B) of the photosensitive drum 31 has already passed the developing unit 39.

(3) When deciding that the timer value has reached the time tvb, the processor 10 starts the developing unit motor 15 rotating through the developing unit motor driving circuit 14 and turns on the developing bias voltage source 49 and the switch SW3 because the uncharged region of the photosensitive drum 31 has already passed the developing unit 39. Further, the processor 10 turns on the blade bias voltage source 50 and the switch SW2 to apply a blade bias voltage (−100 V) to both the blade holder 43 and the reset roller 46. Thus, the developing roller 40 rotates with a developing bias voltage (−350 V) applied thereto, and a blade bias voltage (−450 V) is applied to both the blade 42 and the reset roller 46. Thus, toner feed and toner charging operations by the developing roller 40 are carried out.

(4) The processor 10 starts the internal timer at the same time as it executes Step (3), and checks whether or not the timer value has reached a predetermined value. The predetermined value is a period of time required for the toner to be satisfactorily charged by the rotation of the developing roller 40.

(5) When the period of time required for the toner to be satisfactorily charged has elapsed, the processor 10 instructs the sheet pickup roller driving mechanism 16 to drive the pickup roller (not shown) to pick up a sheet from the sheet cassette (not shown) and feed it toward the transfer unit 51.

(6) In addition, the processor 10 starts the internal timer, and checks whether or not the timer value has reached a predetermined value. The predetermined value is a period of time tex determined by subtracting a period of time tvt required for the photosensitive drum 31 to reach the transfer unit position from the image exposure position from a period of time required for the sheet to reach the transfer unit position from the pickup position. That is, the predetermined time is a period of time required for the sheet to reach a position on the sheet feed path which is away from the transfer unit position by the distance from the image exposure position of the photosensitive drum 31 to the transfer unit position. Thus, the feed of the sheet and the image exposure are synchronized with each other.

When deciding that the timer value has reached the time tex, the processor 10 instructs the laser optical system 38 to start image exposure, thereby starting image exposure for one page.

(7) Next, the processor 10 starts the internal timer, and checks whether or not the timer value has reached a predetermined value. The predetermined value is a period of time tvt required for the photosensitive drum 31 to reach the transfer unit position from the image exposure position. When deciding that the timer value has reached the time tvt, the processor 10 turns on the transfer bias voltage source 53 and the switch SW4 to apply the transfer bias voltage to the transfer roller 52 because the toner image formed by the image exposure has reached the transfer position and the sheet has also reached the transfer position. Thus, the toner image on the photosensitive drum 31 is electrostatically and mechanically transferred to the sheet.

(8) Upon completion of the image exposure for the first page, the processor 10 makes a check for the arrival of data on the next page. If data on the next page arrives within a predetermined period of time, the processor 10 executes Steps (5) and so forth to start printing for the next page.

On the other hand, if no next page data is available, the processor 10 decides the printing to be terminated, and executes a termination sequence. The termination sequence includes an operation of turning off the main motor 12, the charging bias voltage source for the charger 32 and the developing bias voltage source and blade bias voltage source for the developing unit 39 and the transfer bias voltage source.

Thus, in this embodiment also, the developing bias voltage application timing is delayed so that no developing bias voltage is applied when the uncharged region of the photosensitive drum 31 passes the developing unit 39, thereby preventing the toner from adhering to the uncharged region at the developing unit 39, which would otherwise occur by the application of the developing bias voltage.

The uncharged toner in the developing unit 39 may adhere to the uncharged region even if the developing bias voltage is not applied. To prevent the adhesion of the uncharged toner to the uncharged region, a developing unit motor is provided separately, and the developing unit 39 is not activated so that the developing roller 40 is fixed in the early stage of the operation. Accordingly, only a fixed portion of the developing roller 40 is allowed to contact the uncharged region of the photosensitive drum 31 in the early stage of the operation. Therefore, only the toner on the contact portion of the developing roller 40 can adhere to the uncharged region. Thus, it is possible to further minimize the amount of toner adhering to the uncharged region.

Figure 15:
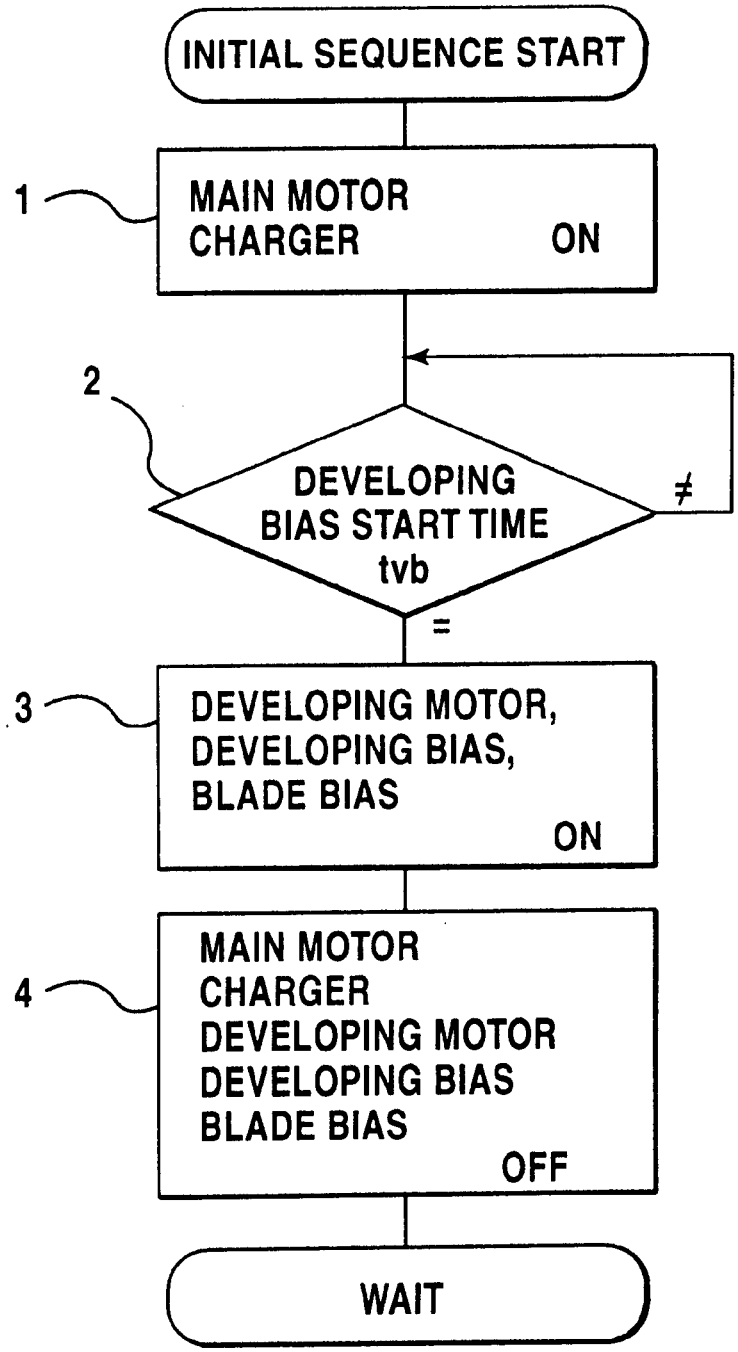
FIG. 15 is a flowchart showing initial processing according to a third embodiment of the present invention.
Figure 16:
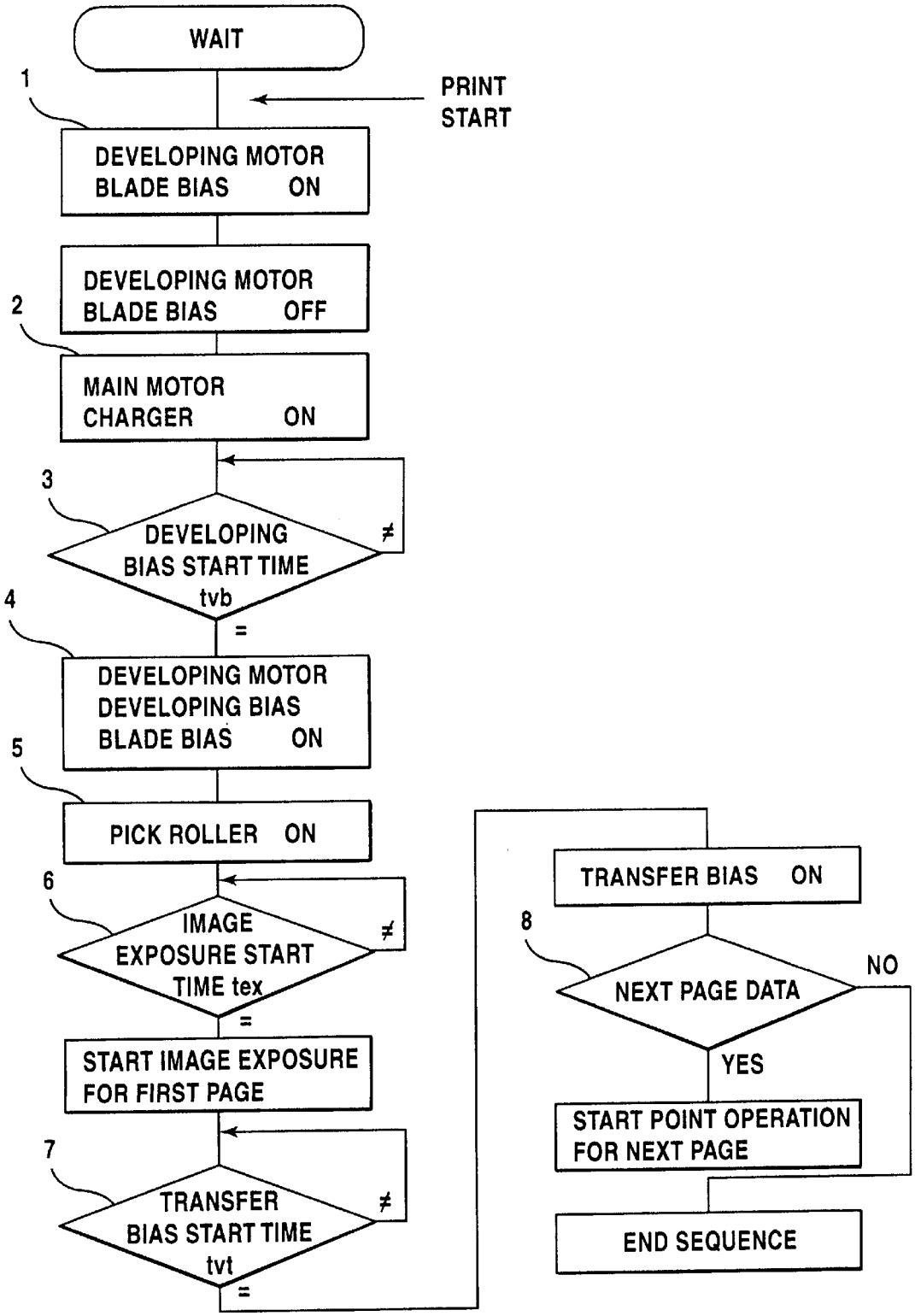
FIG. 16 is a flowchart showing printing processing according to the third embodiment of the present invention.
Figure 17:
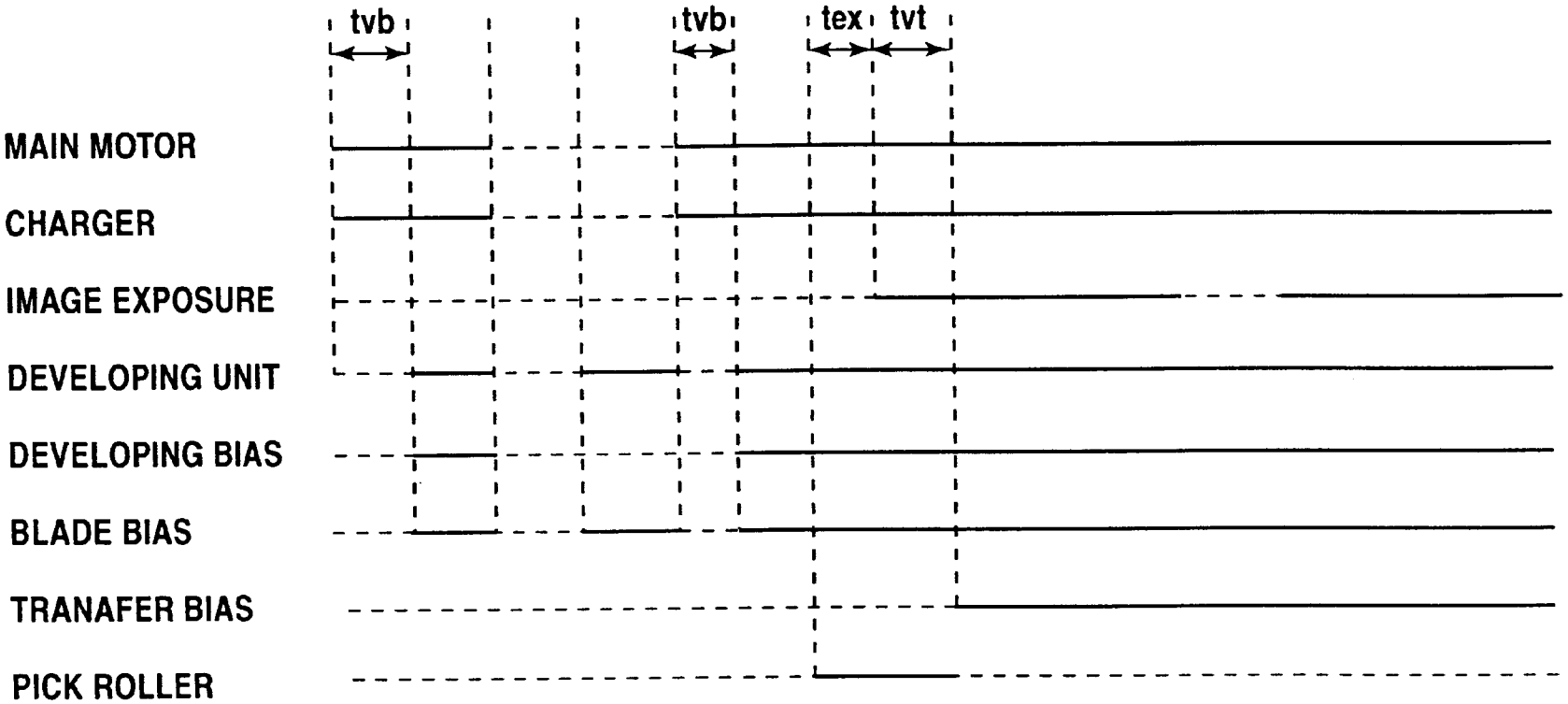
FIG. 17 is a timing chart of the processing operations shown in FIGS. 15 and 16.

FIG. 15 is a flowchart showing initial processing according to a third embodiment of the present invention. FIG. 16 is a flowchart showing printing processing according to the third embodiment of the present invention. FIG. 17 is a timing chart of the processing operations according to the third embodiment of the present invention. It should be noted that in this embodiment also the main motor 12 and the developing unit motor 15 are provided for respective purposes, as in the arrangement shown in FIG. 7, in the same way as in the embodiment shown in FIG. 12. However, the image forming apparatus in this embodiment is of the type in which the transfer roller 52 is held in contact with the photosensitive drum 31 at all times without being withdrawn therefrom.

As will be clear from FIG. 15, the initial processing that is executed before the printing processing shown in FIG. 16 is the same as in the embodiment shown in FIG. 12. Accordingly, in the initial sequence that precedes a printing operation, the processor 10 starts the photosensitive drum 31 rotating and activates the charger 32, and after the uncharged region of the photosensitive drum 31 has passed the developing unit 39, the processor 10 drives the developing unit 39 and applies a developing bias voltage and a blade bias voltage to the developing unit 39 in the same way as in the embodiment shown in FIG. 12. Thus, it is possible to minimize the amount of toner adhering to the uncharged region at the developing unit 39.

Further, in the early stage of the operation, the developing unit 39 is not in operation, and hence the developing roller 40 is not in rotation for feeding toner. Accordingly, only a part of the developing roller 40 is in contact with the uncharged region of the photosensitive drum 31, and only the toner present on the contact portion of the developing roller 40 can adhere to the uncharged region. Thus, it is possible to prevent the adhesion of toner to the uncharged region at the developing unit 39 even more effectively.

Next, the printing processing operation will be explained with reference to FIG. 16.

(1) If a print command arrives when the system is in the stand-by state, a printing operation starts. First, the processor 10 starts the developing unit motor 15 rotating through the developing unit motor driving circuit 14 and turns on the blade bias voltage source 50 and the switch SW2 to apply a blade bias voltage (−100 V) to both the blade holder 43 and the reset roller 46. Consequently, the developing roller 40 rotates, and a voltage of −100 V is applied between the developing roller 40 and the blade 42 and between the developing roller 40 and the reset roller 46, thereby effecting charging of toner through the toner feed carried out by the developing roller 40 and forced charging of toner by the blade 42.

This operation is suitably performed for at least a period of time corresponding to one turn of the developing roller 40. Thus, the toner present on the periphery of the developing roller 40 is satisfactorily charged, and substantially no toner remains uncharged on the developing roller 40. After this operating time has elapsed, the processor 10 suspends the developing unit motor 15 through the developing unit motor driving circuit 14 and turns off the blade bias voltage source 50 and the switch SW2.

(2) The subsequent Steps are the same as Steps (1) to (8) in the embodiment shown in FIG. 13. That is, the processor 10 controls the main motor driving circuit 11 to drive the main motor 12 and turns on the charging bias voltage sources 34 and 35 and the switch SW1 to start charging. Thus, the photosensitive drum 31 rotates, and the charger 32 charges the photosensitive drum 31. At this time, the developing roller 40 and other rollers in the developing unit 39 do not rotate.

(3) The processor 10 starts the internal timer at the same time as it executes Step (2), and checks whether or not the timer value has reached a predetermined value. The predetermined value is the above-described time tvb. Accordingly, when the timer value indicates the time tvb, it means that the above-described uncharged region of the photosensitive drum 31 has passed the developing unit 39.

(4) When deciding that the timer value has reached the time tvb, the processor 10 starts the developing unit motor 15 rotating through the developing unit motor driving circuit 14 and turns on the developing bias voltage source 49 and the switch SW3 because the uncharged region of the photosensitive drum 31 has already passed the developing unit 39. Further, the processor 10 turns on the blade bias voltage source 50 and the switch SW2 to apply a blade bias voltage (−100 V) to both the blade holder 43 and the reset roller 46. Thus, the developing roller 40 rotates with a developing bias voltage (−350 V) applied thereto, and a blade bias voltage (−450 V) is applied to both the blade 42 and the reset roller 46. Thus, toner feed and toner charging operations by the developing roller 40 are carried out.

(5) Next, the processor 10 activates the sheet pickup roller driving mechanism 16 to drive the pickup roller (not shown) to pick up a sheet from the sheet cassette (not shown) and feed it toward the transfer unit 51.

(6) In addition, the processor 10 starts the internal timer, and checks whether or not the timer value has reached a predetermined value. The predetermined value is the above-described time tex. That is, the predetermined time is a period of time required for the sheet to reach a position on the sheet feed path which is away from the transfer unit position by the distance from the image exposure position of the photosensitive drum 31 to the transfer unit position. Thus, the feed of the sheet and the image exposure are synchronized with each other.

When deciding that the timer value has reached the time tex, the processor 10 instructs the laser optical system 38 to start image exposure, thereby starting image exposure for one page.

(7) Next, the processor 10 starts the internal timer, and checks whether or not the timer value has reached a predetermined value. The predetermined value is a period of time tvt required for the photosensitive drum 31 to reach the transfer unit position from the image exposure position. When deciding that the timer value has reached the time tvt, the processor 10 turns on the transfer bias voltage source 53 and the switch SW4 to apply the transfer bias voltage to the transfer roller 52 because the toner image formed by the image exposure has reached the transfer position and the sheet has also reached the transfer position. Thus, the toner image on the photosensitive drum 31 is electrostatically and mechanically transferred to the sheet.

(8) Upon completion of the image exposure for the first page, the processor 10 makes a check for the arrival of data on the next page. If data on the next page arrives within a predetermined period of time, the processor 10 executes Steps (5) and so forth to start printing for the next page.

On the other hand, if no next page data is available, the processor 10 decides the printing to be terminated, and executes a termination sequence. The termination sequence includes an operation of turning off the main motor 12, the charging bias voltage source for the charger 32 and the developing bias voltage source and blade bias voltage source for the developing unit 39 and the transfer bias voltage source.

Thus, in this embodiment also, the developing bias voltage application timing is delayed so that no developing bias voltage is applied when the uncharged region of the photosensitive drum 31 passes the developing unit 39, thereby preventing the toner from adhering to the uncharged region at the developing unit 39, which would otherwise occur by the application of the developing bias voltage.

The uncharged toner in the developing unit 39 may adhere to the uncharged region even if the developing bias voltage is not applied. To prevent the adhesion of the uncharged toner to the uncharged region, the developing unit motor 15 is provided separately, and the developing unit 39 is activated before the starting of the operation of the main motor 12, that is, the rotation of the photosensitive drum 31, thereby satisfactorily charging the toner present on the periphery of the developing roller 40 of the developing unit 39 and eliminating the presence of uncharged toner. Thus, when the uncharged region of the photosensitive drum 31 rotated by turning on the main motor 12 passes the developing unit 39 at Step (2), the amount of uncharged toner adhering to the uncharged region is further minimized.

Furthermore, in the subsequent early stage (Steps (2) and (3)), the developing unit 39 is held in an inoperative state, and the developing roller 40 is fixed so that only a fixed portion of the developing roller 40 is allowed to contact the uncharged region of the photosensitive drum 31. Accordingly, only the uncharged toner on the contact portion of the developing roller 40 can adhere to the uncharged region. Thus, it is possible to further minimize the amount of toner adhering to the uncharged region.

Figure 18:
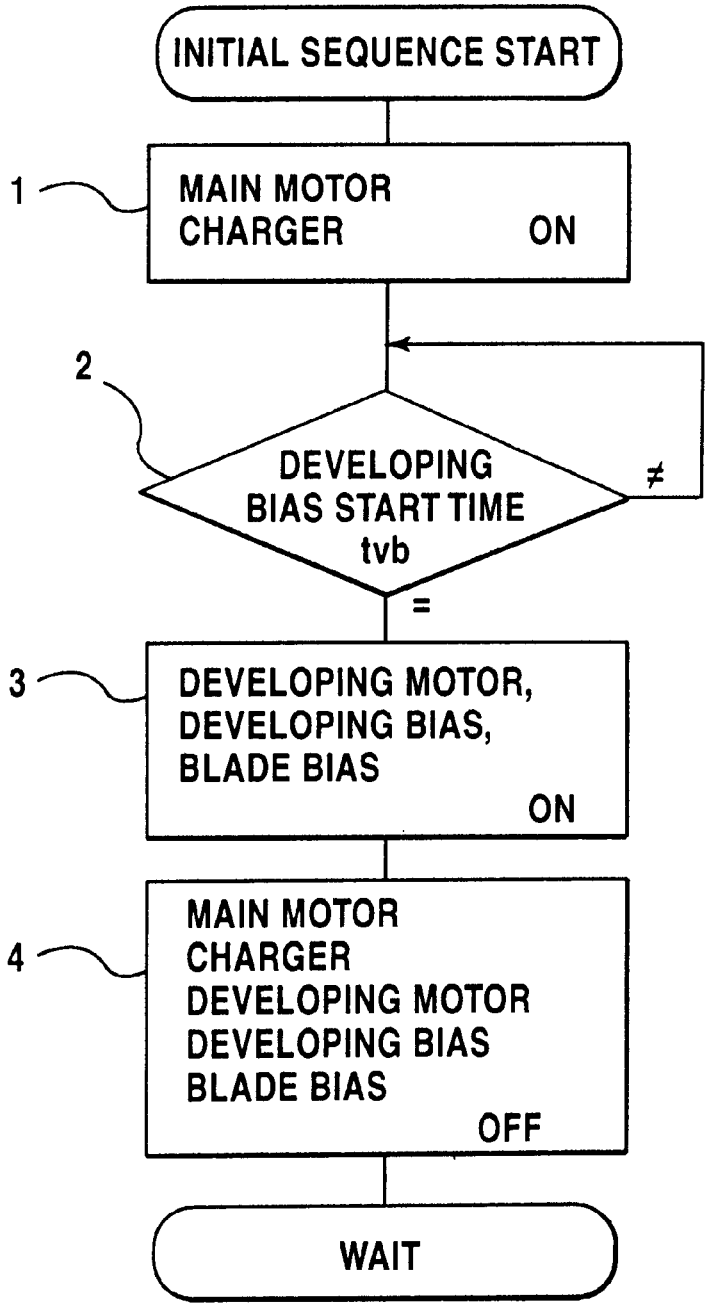
FIG. 18 is a flowchart showing initial processing according to a fourth embodiment of the present invention.
Figure 19:
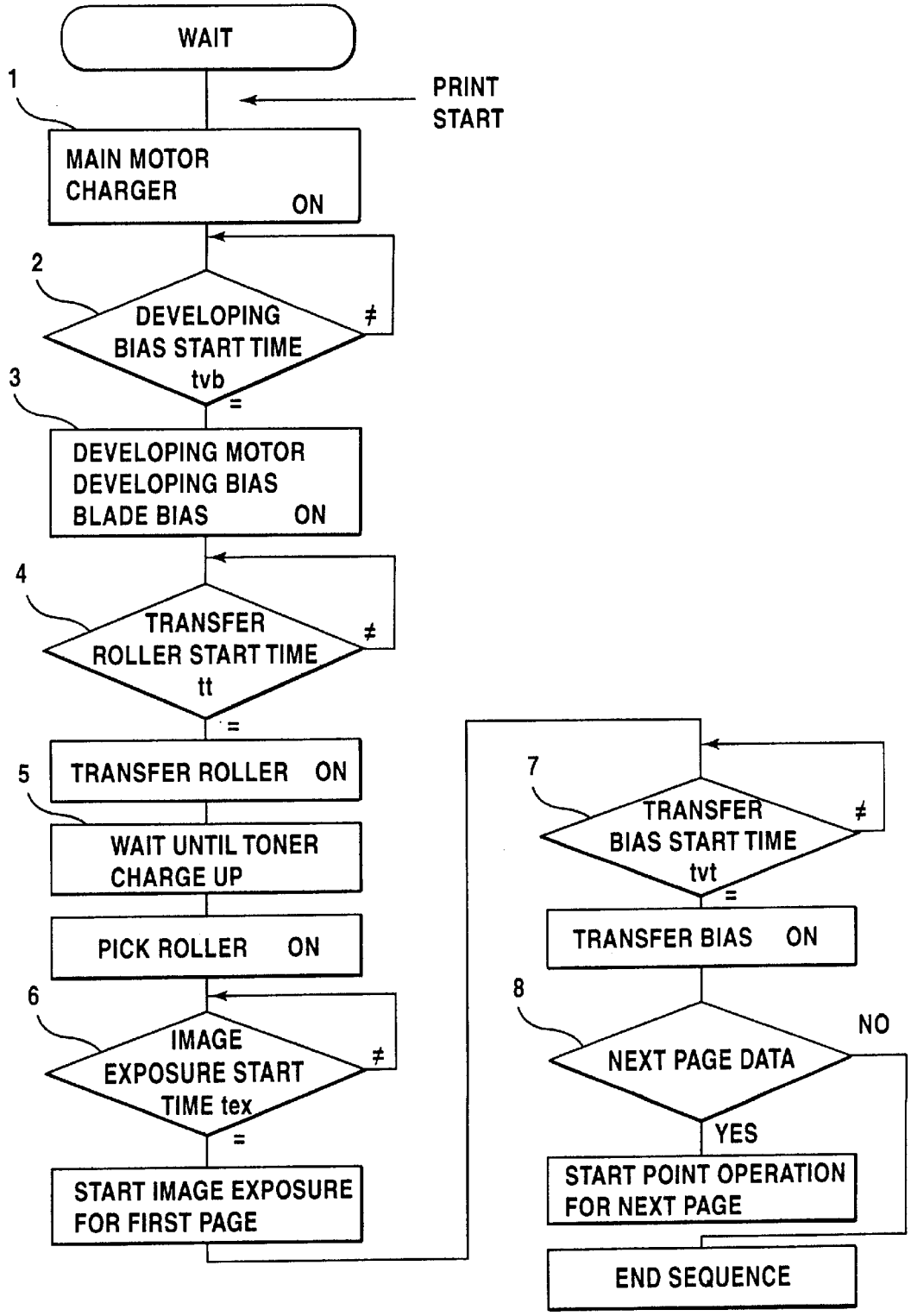
FIG. 19 is a flowchart showing printing processing according to the fourth embodiment of the present invention.
Figure 20:
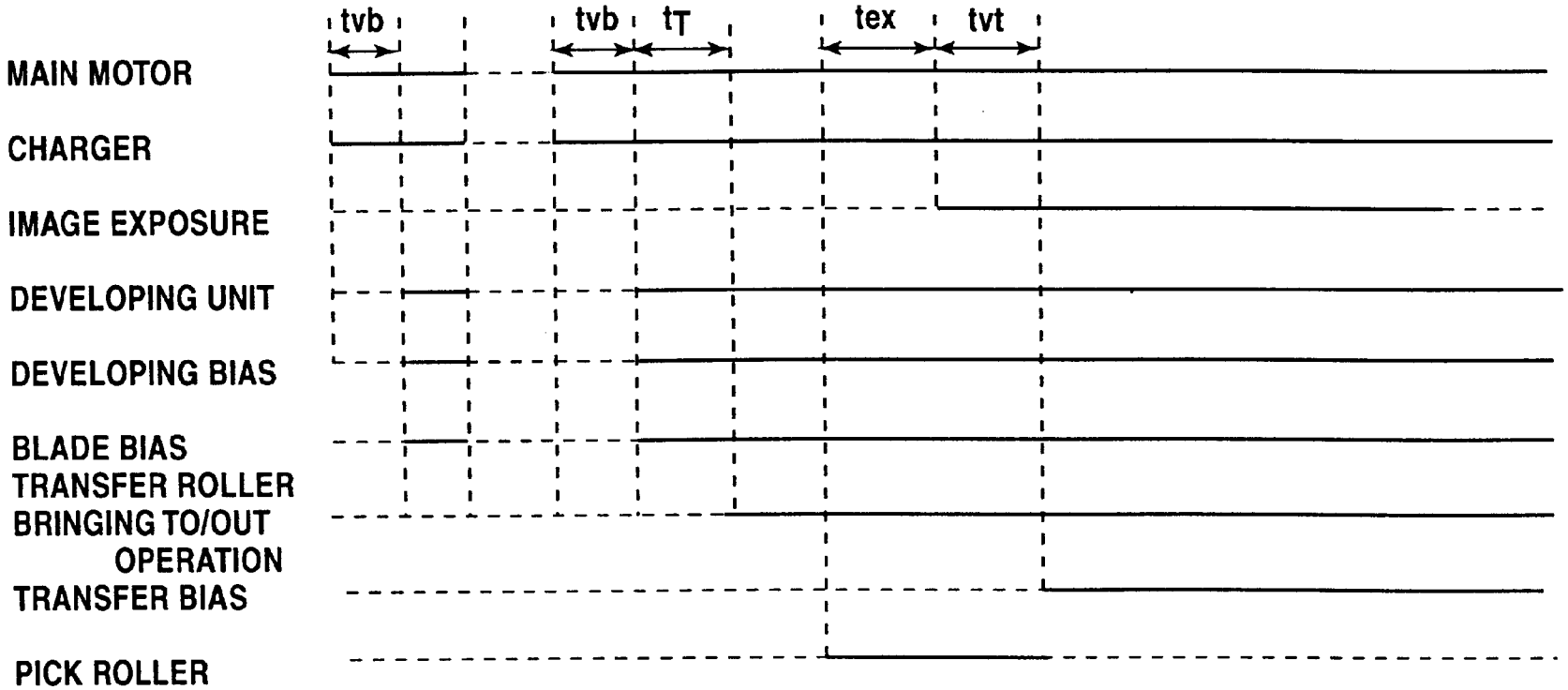
FIG. 20 is a timing chart of the processing operations shown in FIGS. 18 and 19.

FIG. 18 is a flowchart showing initial processing according to a fourth embodiment of the present invention. FIG. 19 is a flowchart showing printing processing according to the fourth embodiment of the present invention. FIG. 20 is a timing chart of the processing operations according to the fourth embodiment of the present invention. In this embodiment, the developing unit motor 15 is provided separately from the main motor 12 as in the arrangement shown in FIG. 7, and the image forming apparatus is of the type in which the transfer roller 52 is selectively brought into and out of contact with the photosensitive drum 31. Further, in this embodiment, the processing for contact control of the transfer roller 52 in the embodiment shown in FIG. 7 is added to the printing processing in the embodiment shown in FIGS. 12 to 14.

In this embodiment, the initial processing that is carried out before the printing processing shown in FIG. 19 is the same as in the embodiments respectively shown in FIGS. 12 and 15. That is, in the initial sequence that precedes a printing operation, the main motor 12 for rotating the photosensitive drum 31 and the charger 32 are activated, and after the uncharged region of the photosensitive drum 31 has passed the developing unit 39, a developing bias voltage is applied to the developing unit 39. Accordingly, it is possible to minimize the amount of toner adhering to the uncharged region at the developing unit 39.

Further, when the uncharged region passes the developing unit 39 in the early stage of the operation, the developing unit 39 is not in operation, and hence the developing roller 40 is not in rotation. Thus, no toner is fed to the photosensitive drum 31. Accordingly, only the toner on that portion of the developing roller 40 which is in contact with the photosensitive drum 31 acts on the uncharged region of the photosensitive drum 31. It is therefore possible to further minimize the amount of toner adhering to the uncharged region of the photosensitive drum 31.

Next, the printing processing operation will be explained with reference to FIG. 19.

(1) If a print command arrives when the system is in the stand-by state, a printing operation starts. First, the processor 10 controls the main motor driving circuit 11 to drive the main motor 12. In addition, the processor 10 turns on the charging bias voltage sources 34 and 35 and the switch SW1 to start charging. Thus, the photosensitive drum 31 rotates, and the charger 32 charges the photosensitive drum 31. On the other hand, the developing roller 40 in the developing unit 39 does not rotate.

(2) The processor 10 starts the internal timer at the same time as it executes Step (1), and checks whether or not the timer value has reached a predetermined value. The predetermined value is the above-described time tvb. Accordingly, when the timer value indicates the time tvb, it means that the above-described uncharged region of the photosensitive drum 31 has already passed the developing unit 39.

(3) When deciding that the timer value has reached the time tvb, the processor 10 starts the developing unit motor 15 rotating through the developing unit motor driving circuit 14 and turns on the developing bias voltage source 49 and the switch SW3 because the uncharged region of the photosensitive drum 31 has already passed the developing unit 39. Further, the processor 10 turns on the blade bias voltage source 50 and the switch SW2 to apply a blade bias voltage (−100 V) to both the blade holder 43 and the reset roller 46. Thus, the developing roller 40 rotates with a developing bias voltage (−350 V) applied thereto, and a blade bias voltage (−450 V) is applied to both the blade 42 and the reset roller 46. Thus, toner feed and toner charging operations by the developing roller 40 are carried out.

(4) The processor 10 starts the internal timer at the same time as it executes Step (3), and checks whether or not the timer value has reached a predetermined value. The predetermined value is the above-described time tt. Accordingly, when the timer value indicates the time tt, it means that the above-described uncharged region of the photosensitive drum 31 has already passed the transfer unit 51.

When deciding that the timer value has reached the time tt, the processor 10 activates the transfer roller moving mechanism to bring the transfer roller 52 into contact with the photosensitive drum 31 because the uncharged region of the photosensitive drum 31 has already passed the transfer unit 51. Thus, since the transfer roller 52 is brought into contact with the photosensitive drum 31 after the uncharged region of the photosensitive drum 31 has passed the transfer unit 51, even if a slight amount of toner adheres to the uncharged region at the developing unit 39, there is no possibility of the toner in the uncharged region adhering to the transfer roller 52.

(5) Next, the processor 10 starts the internal timer, and checks whether or not the timer value has reached a predetermined value. The predetermined value is a period of time required for the toner to be satisfactorily charged by the rotation of the developing roller 40. When the period of time required for the toner to be satisfactorily charged has elapsed, the processor 10 instructs the sheet pickup roller driving mechanism 16 to drive the pickup roller (not shown) to pick up a sheet from the sheet cassette (not shown) and feed it toward the transfer unit 51.

(6) In addition, the processor 10 starts the internal timer, and checks whether or not the timer value has reached a predetermined value. The predetermined value is the above-described period of time tex. That is, the predetermined time is a period of time required for the sheet to reach a position on the sheet feed path which is away from the transfer unit position by the distance from the image exposure position of the photosensitive drum 31 to the transfer unit position. Thus, the feed of the sheet and the image exposure are synchronized with each other.

When deciding that the timer value has reached the time tex, the processor 10 instructs the laser optical system 38 to start image exposure, thereby starting image exposure for one page.

(7) Next, the processor 10 starts the internal timer, and checks whether or not the timer value has reached a predetermined value. The predetermined value is a period of time tvt required for the photosensitive drum 31 to reach the transfer unit position from the image exposure position. When deciding that the timer value has reached the time tvt, the processor 10 turns on the transfer bias voltage source 53 and the switch SW4 to apply the transfer bias voltage to the transfer roller 52 because the toner image formed by the image exposure has reached the transfer position and the sheet has also reached the transfer position. Thus, the toner image on the photosensitive drum 31 is electrostatically and mechanically transferred to the sheet.

(8) Upon completion of the image exposure for the first page, the processor 10 makes a check for the arrival of data on the next page. If data on the next page arrives within a predetermined period of time, the processor 10 executes Steps (5) and so forth to start printing for the next page.

On the other hand, if no next page data is available, the processor 10 decides the printing to be terminated, and executes a termination sequence. The termination sequence includes an operation of turning off the main motor 12, the charging bias voltage source for the charger 32 and the developing bias voltage source and blade bias voltage source for the developing unit 39, an operation of withdrawing the transfer roller 52 from the photosensitive drum 31, and an operation of turning off the transfer bias voltage source.

Thus, in this embodiment also, the developing bias voltage application timing is delayed so that no developing bias voltage is applied when the uncharged region of the photosensitive drum 31 passes the developing unit 39, thereby preventing the toner from adhering to the uncharged region at the developing unit 39, which would otherwise occur by the application of the developing bias voltage.

The uncharged toner in the developing unit 39 may adhere to the uncharged region even if the developing bias voltage is not applied. To prevent the adhesion of the uncharged toner to the uncharged region, the developing unit motor 15 is provided separately, and the developing unit 39 is not activated so that the developing roller 40 is fixed in the early stage of the operation. Accordingly, only a fixed portion of the developing roller 40 is allowed to contact the uncharged region of the photosensitive drum 31 in the early stage of the operation. Therefore, only the toner on the contact portion of the developing roller 40 can adhere to the uncharged region, and it is possible to further minimize the amount of toner adhering to the uncharged region.

Furthermore, since the transfer roller 52 is brought into contact with the photosensitive drum 31 after the uncharged region has passed the transfer roller 52, even if a slight amount of toner adheres to the photosensitive drum 31 at the developing unit 39, it is possible to prevent the toner from adhering to the transfer roller 52 and hence possible to prevent the sheet from being stained with toner during printing process.

Figure 21:
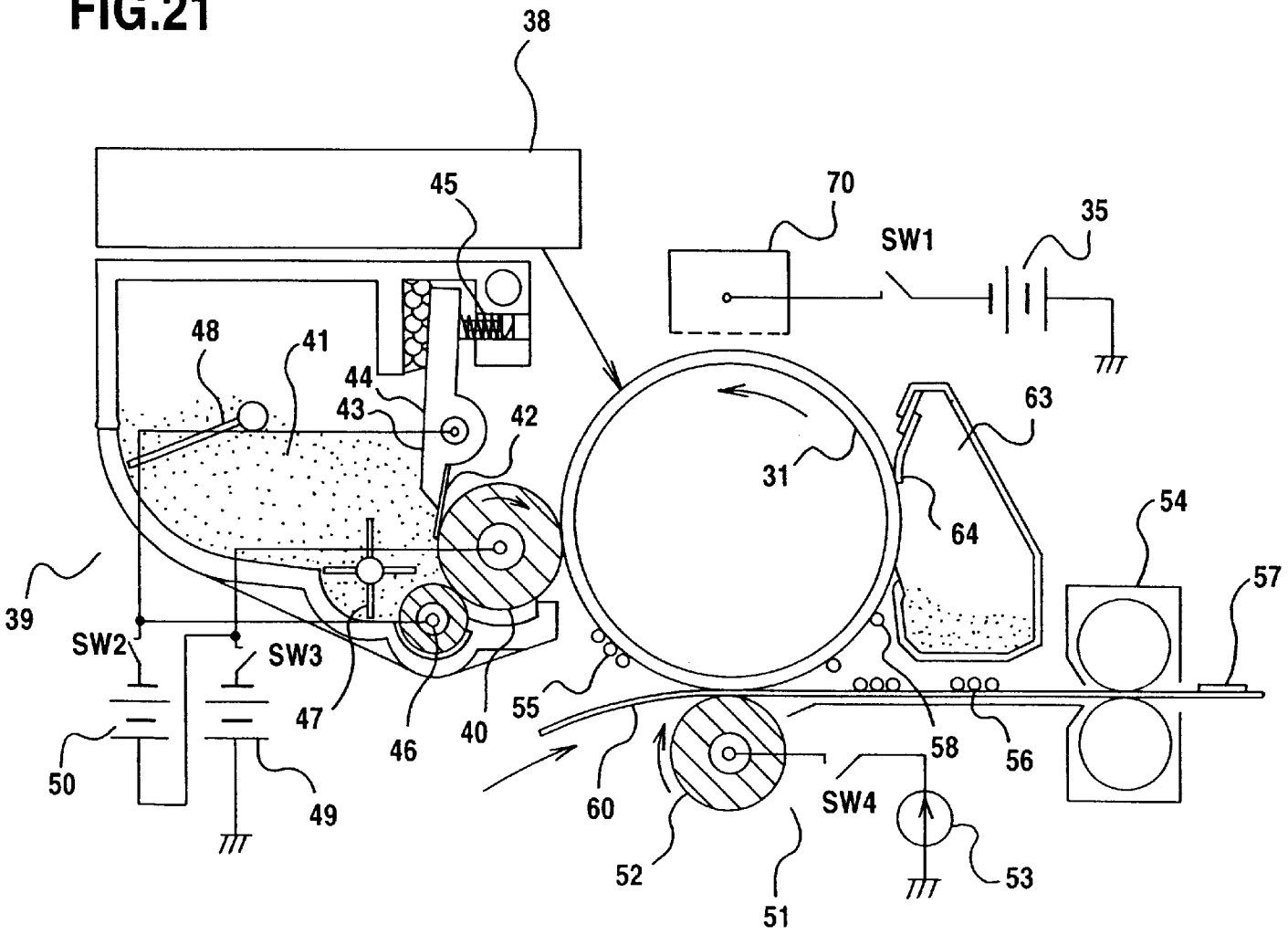
FIG. 21 illustrates the arrangement of another embodiment of the image forming apparatus according to the present invention.

FIG. 21 shows the arrangement of another embodiment of the present invention in which the invention is applied to an electrophotographic printer equipped with a cleaner. In FIG. 21, the same elements as those shown in FIG. 4 are denoted by the same reference numerals.

Referring to FIG. 21, a corona charger 70 is adapted to charge the surface of the photosensitive drum 31 in a non-contact manner. A DC constant-voltage source 35 of minus several kV is connected to the corona charger 70 through a switch SW1. The system is set so that the surface of the photosensitive drum 31 is charged to −700 V by this arrangement.

A cleaner 63 has a cleaning blade 64 which is in contact with the photosensitive drum 31. With the cleaning blade 64, the residual toner on the photosensitive drum 31 is scraped off and collected in the cleaner 63.

With the apparatus of this embodiment also, it is possible to execute the above-described embodiments, that is, the first embodiment (FIGS. 9 to 11), the second embodiment (FIGS. 12 to 14), the third embodiment (FIGS. 15 to 17), and the fourth embodiment (FIGS. 18 to 20). Thus, it is possible to obtain advantageous effects similar to those of the described embodiments.

The foregoing embodiments of the present invention may be modified as follows: Firstly, although in the described embodiments the charging brush 32 is driven with a power source that supplies alternating and direct currents which are superimposed on one another, the charging brush driving power source may be a DC (constant-current) power source. In addition, the constant-current source exemplified as a power source for driving the transfer roller 52 may be a constant-voltage source. Secondly, although a brush charger is employed in the embodiment shown FIG. 4, in which the present invention is applied to a cleanerless process, the charger may be replaced by the corona charger shown in FIG. 21. In this case, if a dispersing brush is provided in between the transfer roller 52 and the corona charger 70, the toner collecting effect at the developing unit 39 can be enhanced. That is, by placing the dispersing brush into contact with the photosensitive drum 31, toner locally remaining on the surface of the photosensitive drum 31 can be dispersed to the entire surface of the photosensitive drum 31, and thus collection of the toner at the developing unit 39 is facilitated. Thirdly, although a porous polyurethane sponge is employed as a material for the developing roller and the transfer roller, other materials may also be employed, e.g., urethane rubber, silicone rubber, silicone system sponge, fluorine system sponge, etc. Fourthly, the transfer roller of the transfer unit includes an endless transfer belt. Further, the endless latent image carrier includes not only a drum-shaped latent image carrier but also a belt-shaped latent image carrier. Fifthly, although in the foregoing embodiments a laser optical system is employed as an image exposure unit, it is also possible to use an LED optical system, a light crystal shutter optical system, an EL (electroluminescence) optical system, etc. Sixthly, is also possible to use non-magnetic and magnetic pulverized toners and spherical polymerization toners. Furthermore, it is not always necessary to employ the toner charging method by application of a blade bias voltage. Seventhly, in the third embodiment shown in FIG. 12 the toner charging process at Step (1) in the printing processing shown in FIG. 13 may be added to the initial processing shown in FIG. 12. Eighthly, although in the foregoing embodiments the present invention is applied to an electrophotographic mechanism, it may also be applied to printing mechanisms adapted to transfer a toner image (e.g., electrostatic recording mechanism). The sheet is not necessarily limited to paper, but other medium may be used in place of paper. Ninthly, although the image forming apparatus in the foregoing embodiments is a printer, it may be other image forming apparatus, e.g., a copying machine, a facsimile, etc.

As has been described above, the present invention provides great advantages as stated below. At the time of starting an operation, the latent image carrier is rotated and the charger is also activated, and after the uncharged region of the latent image carrier has passed the developing section, a developing bias voltage is applied to the developing unit. Accordingly, when the uncharged region of the latent image carrier passes the developing unit, it is possible to prevent adhesion of toner to the uncharged region at the developing unit. Therefore, it is possible to prevent unnecessary consumption of toner and hence lower the running cost. In addition, it is possible to avoid adverse effects of waste toner on environments and to prevent the apparatus from being stained with toner.

What is claimed is:

1. An image forming apparatus for forming an image on a sheet, comprising:

an endless latent image carrier;

means for charging said latent image carrier;

means for forming a latent image on said latent image carrier charged;

means for developing the latent image formed on said latent image carrier with a one component developer by supplying the developer to said latent image carrier under application of a developing bias voltage, said developing means having a developer feed member to carry said developer and having a regulating member for regulating a layer thickness of the developer on said developer feed member, means for transferring the image developed on said latent image carrier to the sheet;

means for rotating said latent image carrier and also driving said developing means to supply the developer to said latent image carrier; and a controller for sequence-controlling said driving means, said charging means and said developing means so that the application of the developing bias voltage to said developing means is started a predetermined time after the rotation of said latent image carrier and the drive of said developing means and also the charging operation of said charging means have been started and so that a bias voltage to the regulating member is applied at the time which the drive of said developing means is started in said sequence control.

2. An image forming apparatus according to claim 1, wherein said controller executes said sequence control in response to an initial command and then stands by for an image formation command, and in response to said image formation command, said controller first executes said sequence control and then controls said latent image forming means and said transfer means to form an image on said sheet.

3. An image forming apparatus according to claim 2, wherein said predetermined time is a period of time required for an uncharged region of said latent image carrier to pass said developing means.

4. An image forming apparatus according to claim 2, wherein said controller permits the transfer operation of said transfer means a predetermined time after the application of said developing bias voltage has been started.

5. An image forming apparatus according to claim 4, wherein said transfer means has a transfer roller and a mechanism for bringing said transfer roller into and out of contact with said latent image carrier.

6. An image forming apparatus according to claim 1, wherein said predetermined time is a period of time required for an uncharged region of said latent image carrier to pass said developing means.

7. An image forming apparatus according to claim 6, wherein said controller permits the transfer operation of said transfer means a predetermined time after the application of said developing bias voltage has been started.

8. An image forming apparatus according to claim 7, wherein said transfer means has a transfer roller and a mechanism for bringing said transfer roller into and out of contact with said latent image carrier.

9. An image forming apparatus according to claim 1, wherein said controller permits the transfer operation of said transfer means a predetermined time after the application of said developing bias voltage has been started.

10. An image forming apparatus according to claim 3, wherein said transfer means has a transfer roller and a mechanism for bringing said transfer roller into and out of contact with said latent image carrier.

11. An image forming apparatus according to claim 1, wherein said developing means is placed in a fixed position such that the developing means is in contact with the latent image carrier both during developing operation and during non-developing operation.

12. An image forming apparatus according to claim 11, wherein said developing means also collects the developer remaining on said latent image carrier after said developed image has been transferred to the sheet, and wherein said image forming apparatus forms the image onto the sheet without a cleaner which removes a residual toner remaining on the latent image carrier after transferring the image developed on said latent image carrier to the sheet.

13. An image forming apparatus for forming an image on a sheet, comprising:

an endless latent image carrier;

means for charging said latent image carrier;

means for forming a latent image on said latent image carrier;

means for developing the latent image formed on said latent image carrier with a one component developer by supplying the developer to said latent image carrier under application of a developing bias voltage, said developing means having a developer feed member to carry said developer and having a regulating member for regulating a layer thickness of the developer on said developer feed member;

means for transferring the image developed on said latent image carrier to the sheet;

means for rotating said latent image carrier and also driving said developing means to supply the developer to said latent image carrier; and a controller for sequence-controlling said driving means, said charging means and said developing means so that the application of the developing bias voltage to said developing means and the drive of said developing means are started a predetermined time after the rotation of said latent image carrier and the charging operation of said charging means have been started, and so that a bias voltage to the regulating member is applied at the time which the drive of said developing means is started in said sequence control.

14. An image forming apparatus according to claim 13, wherein said developing means is placed in a fixed position such that the developing means is in contact with the latent image carrier both during developing operation and during non-developing operation.

15. An image forming apparatus according to claim 13, wherein said developing means also collects the developer remaining on said latent image carrier after said developed image has been transferred to the sheet, and wherein said image forming apparatus forms the image onto the sheet without a cleaner which removes a residual toner remaining on the latent image carrier after transferring the image developed on said latent image carrier to the sheet.

* * * * *